US008011433B2

(12) United States Patent
Chay et al.

(10) Patent No.: US 8,011,433 B2
(45) Date of Patent: Sep. 6, 2011

(54) BIDIRECTIONAL GRAVEL PACKING IN SUBTERRANEAN WELLS

(75) Inventors: Bryan Chay, Kuala Balai (BN); Chee Voon Kin, Jurong East (SG); Mark E. P. Dawson, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 12/424,206

(22) Filed: Apr. 15, 2009

(65) Prior Publication Data

US 2010/0263864 A1 Oct. 21, 2010

(51) Int. Cl.
*E21B 43/04* (2006.01)

(52) U.S. Cl. ..... 166/278; 166/51

(58) Field of Classification Search ..... 166/278, 166/51

See application file for complete search history.

(56) References Cited

U.S. PATENT DOCUMENTS

| | | | | |
|---|---|---|---|---|
| 4,440,218 | A | 4/1984 | Farley | |
| 4,519,451 | A * | 5/1985 | Gray et al. | 166/278 |
| 4,681,163 | A * | 7/1987 | Guidry et al. | 166/278 |
| 4,750,557 | A * | 6/1988 | Gavranovic | 166/51 |
| 6,176,307 | B1 * | 1/2001 | Danos et al. | 166/51 |
| 6,554,064 | B1 * | 4/2003 | Restarick et al. | 166/250.01 |
| 6,644,404 | B2 * | 11/2003 | Schultz et al. | 166/278 |
| 6,675,891 | B2 * | 1/2004 | Hailey et al. | 166/228 |
| 6,684,951 | B2 * | 2/2004 | Restarick et al. | 166/250.01 |
| 7,367,395 | B2 * | 5/2008 | Vidrine et al. | 166/278 |
| 7,422,067 | B2 * | 9/2008 | Fouras et al. | 166/369 |
| 7,661,476 | B2 * | 2/2010 | Yeh et al. | 166/278 |
| 2002/0157837 | A1 * | 10/2002 | Bode et al. | 166/373 |
| 2002/0189808 | A1 | 12/2002 | Nguyen et al. | |
| 2003/0085038 | A1 * | 5/2003 | Restarick et al. | 166/278 |
| 2005/0103495 | A1 * | 5/2005 | Corbett | 166/278 |
| 2005/0236153 | A1 * | 10/2005 | Fouras et al. | 166/278 |
| 2007/0187095 | A1 * | 8/2007 | Walker et al. | 166/278 |
| 2009/0095471 | A1 * | 4/2009 | Guignard et al. | 166/278 |
| 2010/0096130 | A1 | 4/2010 | Parlar et al. | |
| 2010/0163235 | A1 * | 7/2010 | Mootoo et al. | 166/278 |

OTHER PUBLICATIONS

Halliburton Drawing No. PKR TEST Brunei uphill, Nov. 24, 2006, 13 pages.

Halliburton Drawing No. 812ZZ1287 REV OUT Brunei uphill, Aug. 17, 2007, 13 pages.

Halliburton Drawing No. 812ZZ1285 RUN 22, Sep. 18, 2007, 13 pages.

Halliburton Uphill Sand Control Proposal, undated, 10 pages.

Halliburton HAL24396 Drawing, Brunei Single Trip Gravel Pack and Treat System, undated, 36 pages.

Combined Search and Examination Report issued May 14, 2010, for GB Patent Application No. 1006056.4.

* cited by examiner

*Primary Examiner* — Jennifer H Gay
(74) *Attorney, Agent, or Firm* — Marlin R. Smith

(57) ABSTRACT

Systems and methods for bidirectional gravel packing of wells. A gravel packing method includes flowing a gravel slurry in one direction in an annulus formed between a wellbore and a gravel packing assembly, and flowing another gravel slurry in an opposite direction in the annulus. A well system includes a gravel packing assembly positioned in a wellbore; one or more well screens interconnected in the gravel packing assembly; a flow control device, interconnected in the gravel packing assembly, and which selectively permits and prevents flow of a gravel slurry outward from the gravel packing assembly to an exterior of the well screens; another flow control device, interconnected in the gravel packing assembly, and which selectively permits and prevents flow of another gravel slurry outward from the gravel packing assembly to the exterior of the well screens; and the well screens being positioned between the flow control devices.

20 Claims, 46 Drawing Sheets

BIDIRECTIONAL GRAVEL PACKING IN SUBTERRANEAN WELLS

BACKGROUND

This disclosure relates generally to operations performed and equipment utilized in conjunction with a subterranean well and, in an example described below, more particularly provides for bidirectional gravel packing in subterranean wells.

Conventional gravel packing assemblies include, among other components, one or more well screens and a closing sleeve positioned below a packer. Typically, the closing sleeve is connected between the packer and the screens, and is used to direct slurry flow to an annulus surrounding the gravel packing assembly. A work string is received in the gravel packing assembly, and is manipulated to perform various functions, such as setting the packer, and opening and closing the closing sleeve.

Such gravel packing assemblies have the capability of flowing the gravel slurry in only one direction through an annulus formed between the gravel packing assembly and the wellbore. If the gravel prematurely bridges off in the annulus, or if there is an obstruction in the annulus (such as, due to partial collapse of the wellbore, etc.), the entire annulus surrounding the well screens may not be fully gravel packed.

Therefore, it will be appreciated that improvements are needed in the art of gravel packing wellbores.

SUMMARY

In the disclosure below, systems and methods are provided which solve at least one problem in the art. One example is described below in which a gravel slurry can be flowed in both directions through an annulus. Another example is described below in which the gravel slurry is first flowed from one end of a gravel packing assembly into the annulus, and the gravel slurry is then flowed from an opposite end of the gravel packing assembly into the annulus.

In one aspect, a unique method of gravel packing a wellbore is provided to the art. The method includes the steps of: flowing a gravel slurry in one direction in an annulus formed between the wellbore and a gravel packing assembly positioned in the wellbore; and flowing another gravel slurry in an opposite direction in the annulus.

In another aspect, a well system in which a wellbore is gravel packed includes a gravel packing assembly positioned in the wellbore, whereby an annulus is formed between the wellbore and the gravel packing assembly. One or more well screens are interconnected in the gravel packing assembly. A flow control device is interconnected in the gravel packing assembly, and the flow control device selectively permits and prevents flow of a gravel slurry outward from the gravel packing assembly to an exterior of the well screens. Another flow control device is interconnected in the gravel packing assembly. This second flow control device selectively permits and prevents flow of another gravel slurry outward from the gravel packing assembly to the exterior of the well screens. The well screens are positioned between the flow control devices.

In yet another aspect, a method of gravel packing a deviated wellbore includes the steps of: flowing a gravel slurry in one direction relative to a toe of the wellbore, the gravel slurry being flowed in an annulus formed between the wellbore and a gravel packing assembly positioned in the wellbore; and flowing another gravel slurry in the annulus in an opposite direction relative to the toe of the wellbore.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
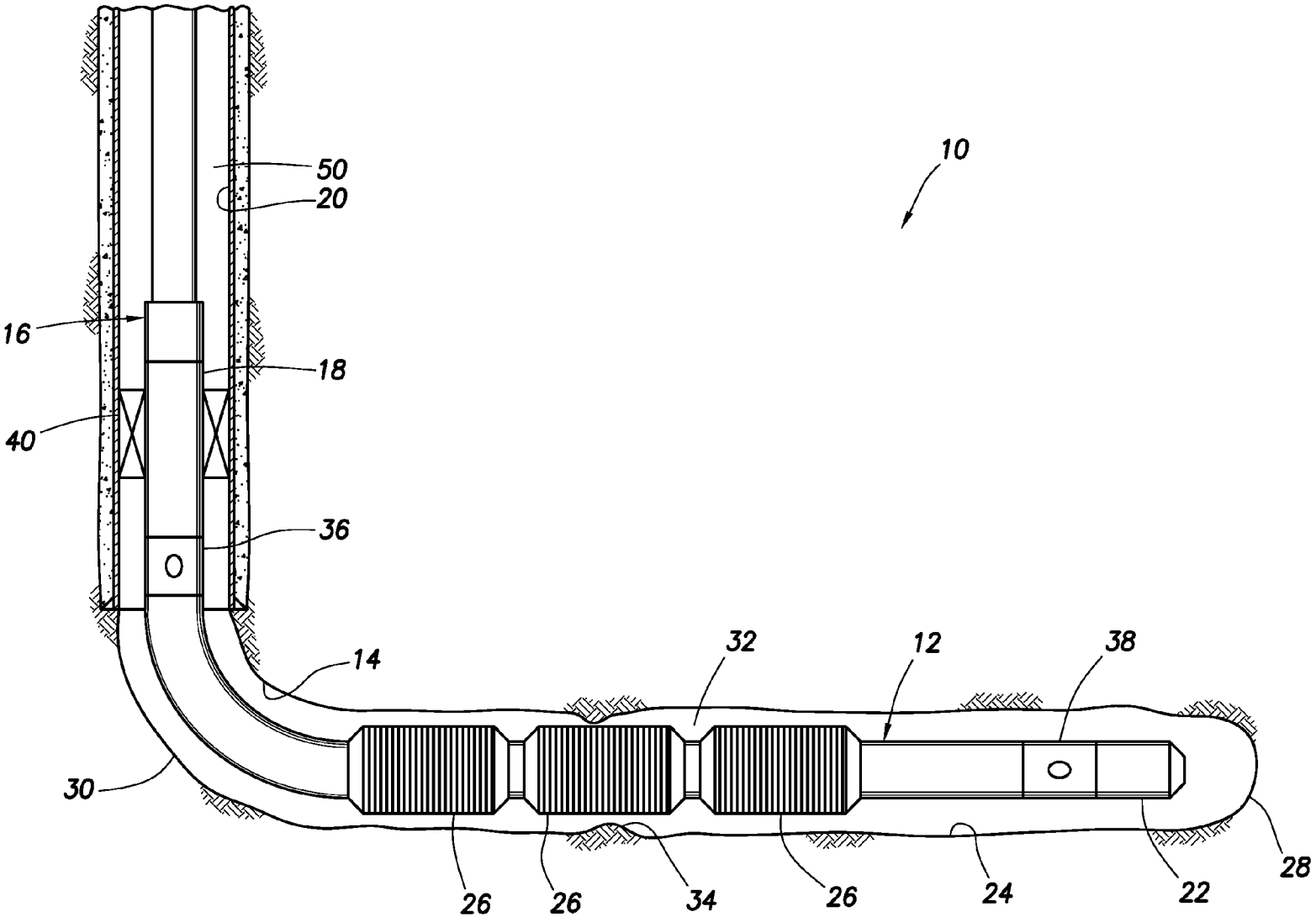
FIG. 1 is a schematic partially cross-sectional view of a well system embodying principles of the present disclosure.

Representatively illustrated in FIG. 1 is a well system 10 and associated method which embody principles of this disclosure. In the well system 10, a gravel packing assembly 12 has been conveyed into a wellbore 14. The gravel packing assembly 12 may be conveyed into the wellbore 14 releasably attached to a generally tubular work string 16.

In the example of FIG. 1, an upper, proximal end 18 of the gravel packing assembly 12 is positioned in a generally vertical cased or lined portion 20 of the wellbore 14, and a distal end 22 of the gravel packing assembly is positioned in a generally horizontal uncased or open hole portion 24 of the wellbore 14. Well screens 26 are interconnected in the gravel packing assembly 12, and are also positioned in the generally horizontal uncased portion 24 of the wellbore 14.

At this point, it should be emphasized that the system 10 as illustrated in the drawings and described herein is merely one example of a wide variety of well systems which can incorporate the principles of this disclosure. For example, it is not necessary for the proximal end 18 of the assembly 12 to be positioned in the cased portion 20 of the wellbore 14, for the distal end 22 or the screens 26 to be positioned in the uncased portion 24 of the wellbore, for the cased portion to be generally vertical, or for the uncased portion to be generally horizontal.

In other examples, the uncased portion 24 could be otherwise deviated, and a toe 28 of the wellbore 14 could even be raised relative to a heel 30 of the wellbore. Thus, it should be clearly understood that the principles of this disclosure are not limited at all to the details of the system 10 illustrated in the drawings and described herein.

In the system 10, it is desired to place a gravel pack in an annulus 32 formed radially between the assembly 12 and the wellbore 14. As is well known to those skilled in the art, a gravel pack is a useful tool for mitigating production of sand and fines from earth formations surrounding wellbores, for preventing collapse of unconsolidated formations, etc. As used herein, the term "gravel" indicates a particulate material, and may be a natural material (such as sand, etc.), a manufactured material (such as glass beads, etc.) and/or a synthetic material (such as plastic, etc.).

In the example of FIG. 1, an obstruction 34 in the wellbore 14 causes a restriction to flow through the annulus 32 and, in conventional gravel packing systems, could operate to prevent complete packing of the annulus about the screens 26. Other problems, such as premature gravel bridging-off, can also prevent complete packing of the annulus 32 in conventional gravel packing systems.

However, the system 10 includes features which enable the entire annulus 32 about the screens 26 to be completely and consistently gravel packed whether or not the obstruction 34 or premature gravel bridging-off occur. These features are especially useful for gravel packing in horizontal or otherwise deviated wellbores where these problems are more frequently encountered, but the system 10 can be very beneficial in substantially vertical wellbores, as well.

One unique feature of the system 10 is that the assembly 12 includes two flow control devices 36, 38 which straddle the screens 26. The upper flow control device 36 is positioned near the proximal end 18 of the assembly 12, below a packer 40, and the lower flow control device 38 is positioned near the distal end 22 of the assembly.

The flow control devices 36, 38 are preferably of the type known to those skilled in the art as "closing sleeves" which selectively permit and prevent fluid communication between the annulus 32 and an interior of the assembly 12. The flow control devices 36, 38 are preferably operated by manipulation of the work string 16, for example, by raising and lowering the work string during different stages of the gravel packing operation (and/or other operations, such as fracturing, stimulating, acid washing, etc.).

In the system 10, the work string 16 may be used to operate both of the flow control devices 36, 38. Alternatively, in an example described more fully below, a first work string can be used to operate one of the flow control devices, and then a second work string can be used to operate the other flow control device. Thus, single or multiple work string trips may be used, in keeping with the principles of this disclosure.

Although only two flow control devices 36, 38 are depicted in the drawings and described herein, it will be appreciated that any number of flow control devices could be used. For example, the assembly 12 could include any number of flow control devices interconnected between multiple sets of screens 26.

Figure 2:
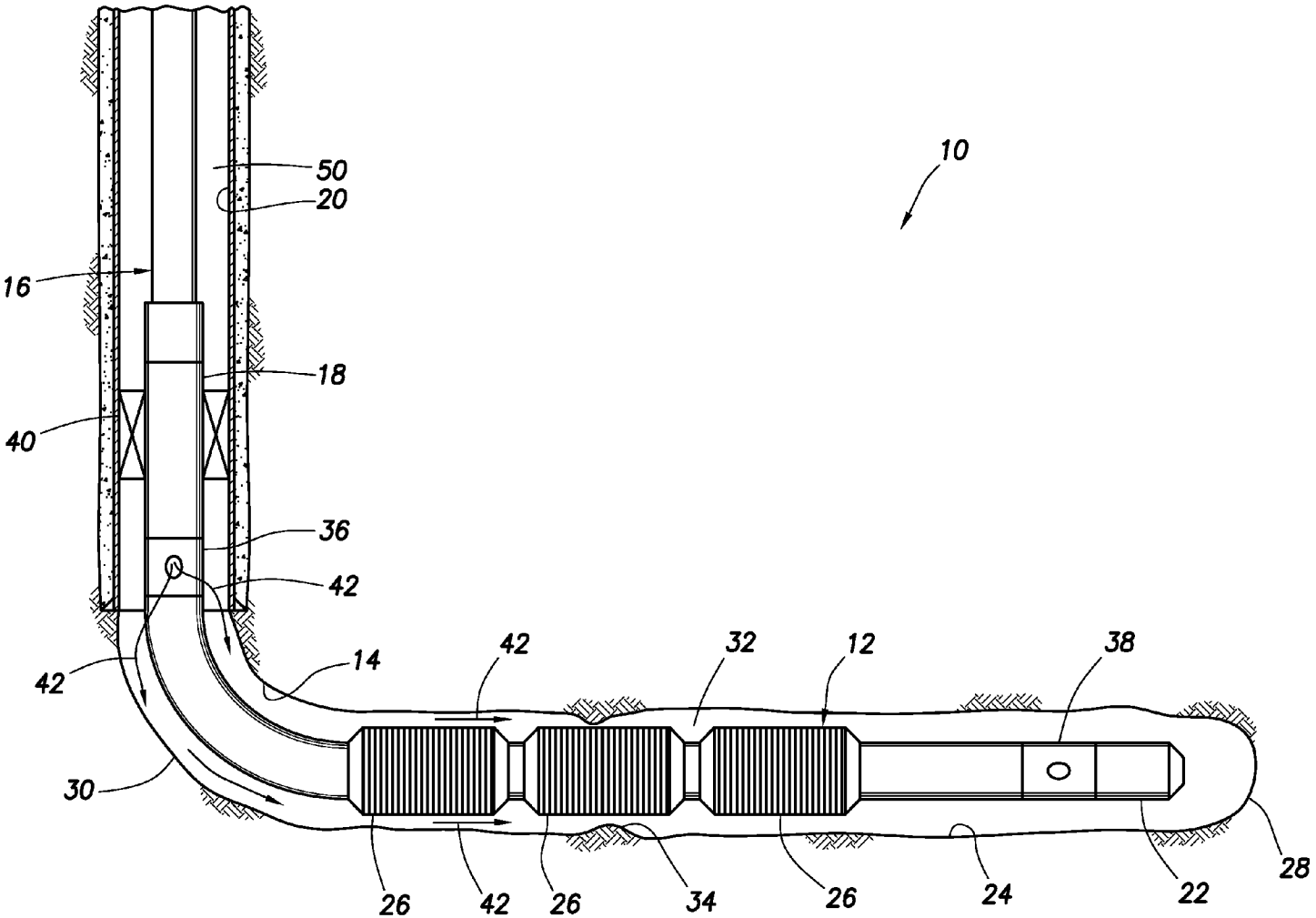
FIG. 2 is a schematic partially cross-sectional view of the well system, wherein a gravel slurry is flowed outwardly into a wellbore.

Referring additionally now to FIG. 2, the system 10 and method are representatively illustrated with a gravel slurry 42 being discharged into the annulus 32 from the upper flow control device 36. The slurry 42 flows through the annulus 32 in a direction from the heel 30 to the toe 28 of the wellbore 14, although the obstruction 34 or other problems may prevent the gravel from completely filling the annulus about the screens 26.

Figure 3:
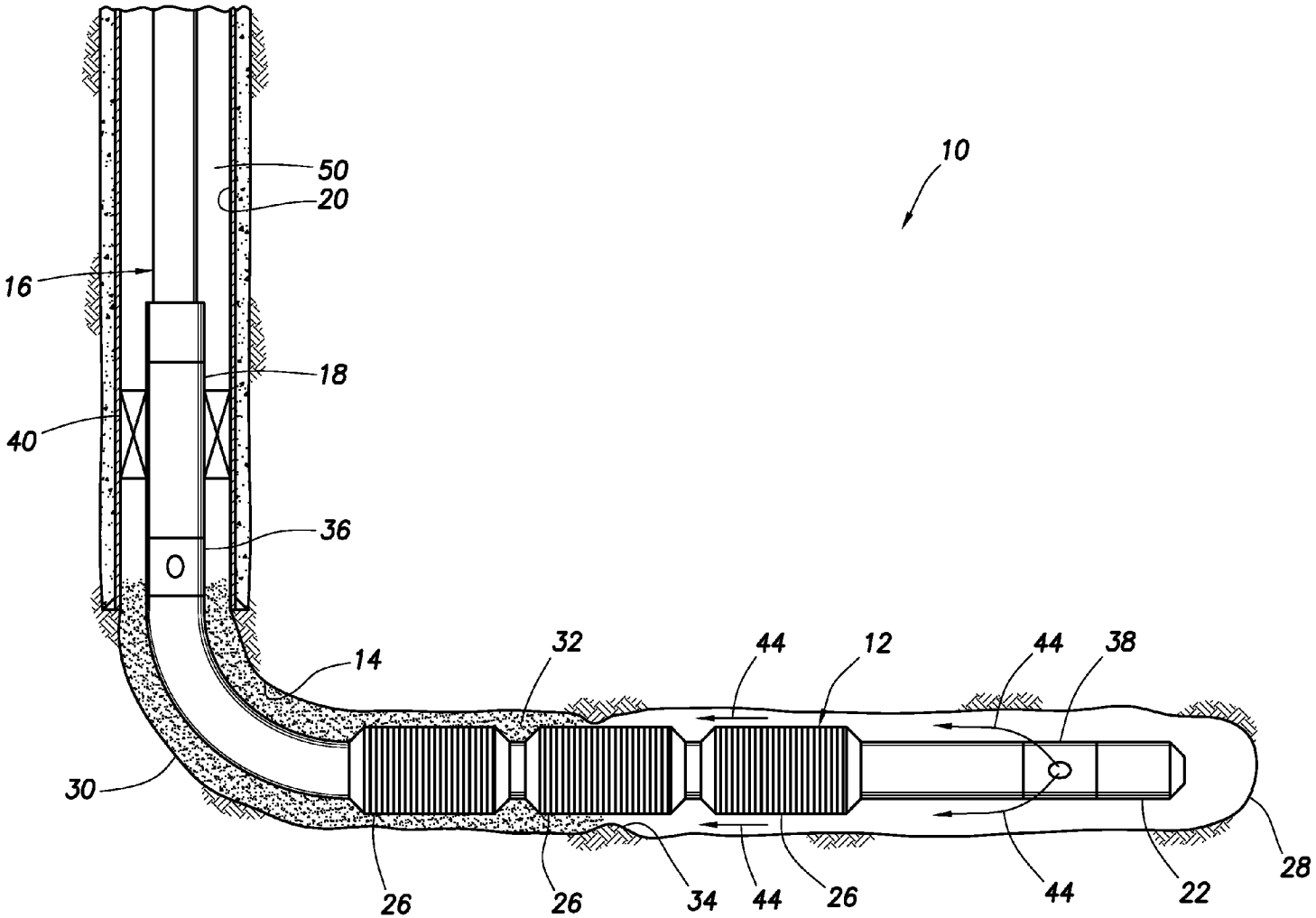
FIG. 3 is a schematic partially cross-sectional view of the well system, wherein another gravel slurry is flowed outwardly into the wellbore.

Referring additionally now to FIG. 3, the system 10 are representatively illustrated with another gravel slurry 44 being discharged into the annulus 32 from the lower flow control device 38. The slurry 44 flows through the annulus 32 in a direction from the toe 28 to the heel 30 of the wellbore 14 (i.e., in the opposite direction from the slurry 42). In this manner, the entire annulus 32 surrounding the screens 26 can be completely packed with gravel, even though the obstruction 34 or premature bridging-off or another problem might otherwise prevent a slurry flowing in only one direction from accomplishing this result.

Note that the two slurries 42, 44 could actually be the same or different in composition. The slurries 42, 44 are referred to separately herein merely to indicate that they are discharged from the separate flow control devices 36, 38.

In the example of FIGS. 1-3, the first slurry 42 is discharged into the annulus 32, and then the second slurry 44 is discharged into the annulus. However, in other examples, the slurries 42, 44 could be discharged simultaneously into the annulus 32.

The slurry 42 is described above and is illustrated in the drawings as being the first discharged from the assembly 12. However, in other examples, the slurry 44 could be first discharged from the lower flow control device 38 before the slurry 42 is discharged from the upper flow control device 36. This latter method may be preferred when the toe 28 of the wellbore 14 is elevated relative to the heel 30 of the wellbore.

Referring additionally now to FIGS. 4A-10P, cross-sectional views of successive axial sections of the gravel packing assembly 12 and the lower portion of the work string 16 are representatively illustrated apart from the remainder of the system 10. It will be appreciated, however, that the assembly 12 and work string 16 may be used in other systems in keeping with the principles of this disclosure.

In the example of FIGS. 4A-10P, one work string **16*a* is used to convey the assembly 12 into the wellbore 14, set the packer 40, operate the upper flow control device 36 and discharge the slurry 42 into the annulus 32. This work string 16*a* is then retrieved from the well, and another work string 16*b* is then engaged with the assembly 12 and is used to operate the lower flow control device 38 and discharge the slurry 44 into the annulus 32**.

In other examples, the work string **16*b* could be used to convey the assembly 12 into the wellbore 14, set the packer 40, operate the lower flow control device 38 and discharge the slurry 44 into the annulus 32. This work string 16*b* could then be retrieved from the well, and the other work string 16*a* could be engaged with the assembly 12 and used to operate the upper flow control device 36 and discharge the slurry 42 into the annulus 32. In that case, the work string 16*b*, instead of the work string 16*a*, would include provisions for conveying the assembly 12 and setting the packer 40**.

In still further examples, the single work string 16 could be used to perform all of these functions (convey the assembly 12, set the packer 40, operate both of the flow control devices 36, 38, etc.). In this manner, only a single trip of the work string 16 into the well would be needed.

Figure 4A:
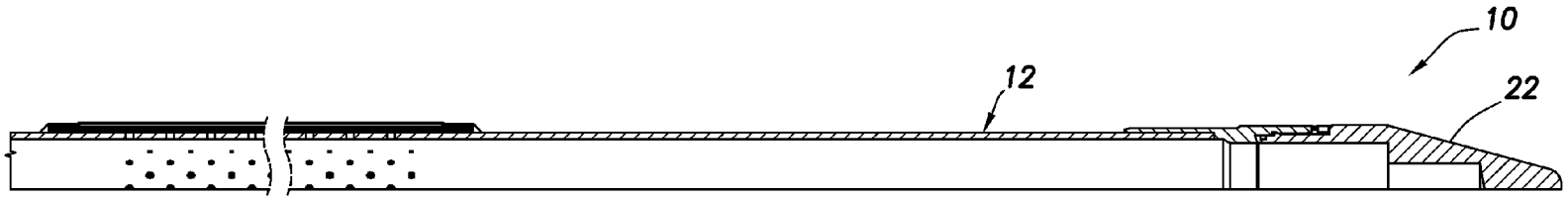
FIGS. 4A-O are schematic quarter-sectional views of a gravel packing assembly and a work string in a run-in configuration.
Figure 4B:
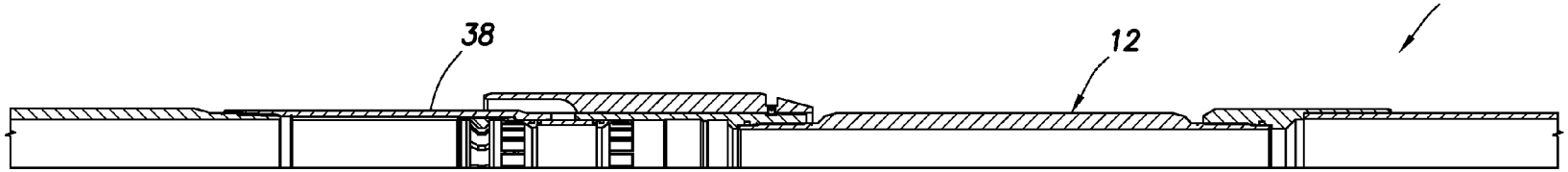
Figure 4C:
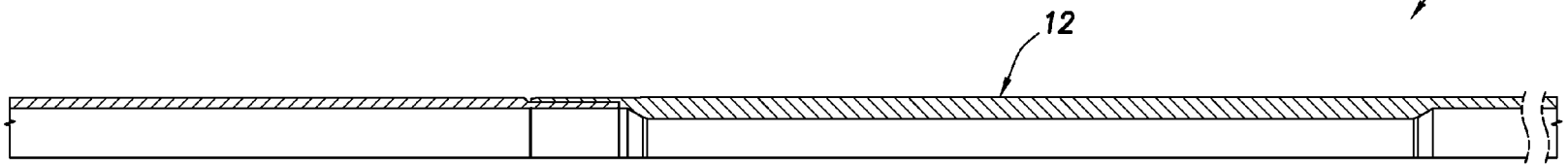
Figure 4D:
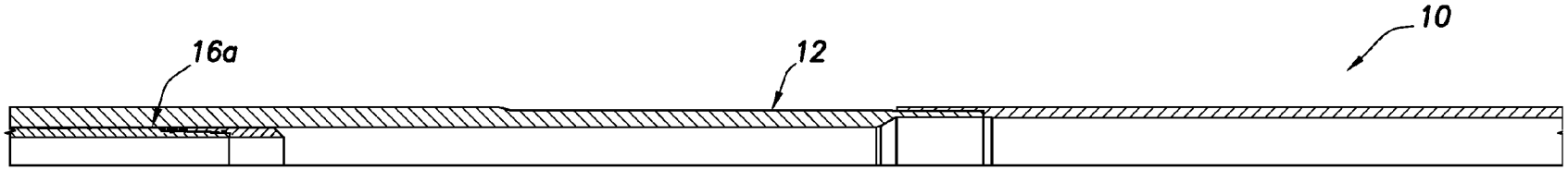
Figure 4E:
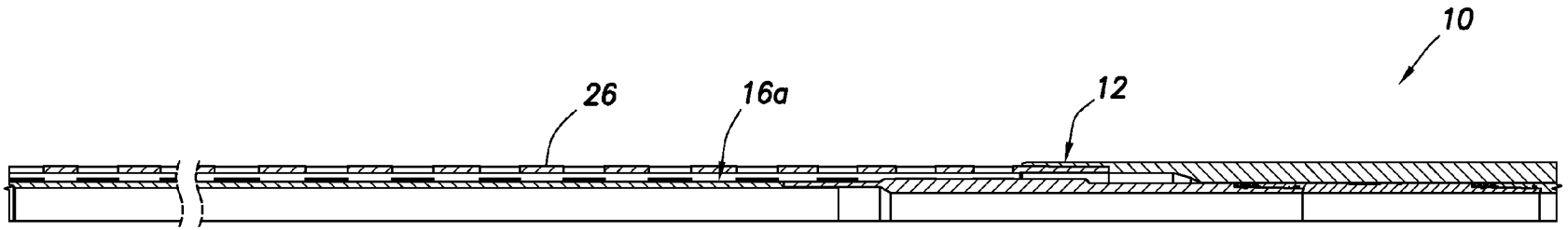
Figure 4F:
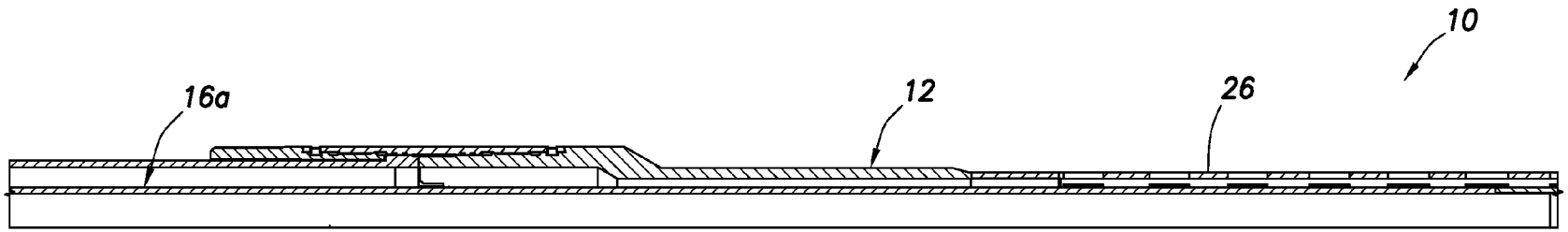
Figure 4G:
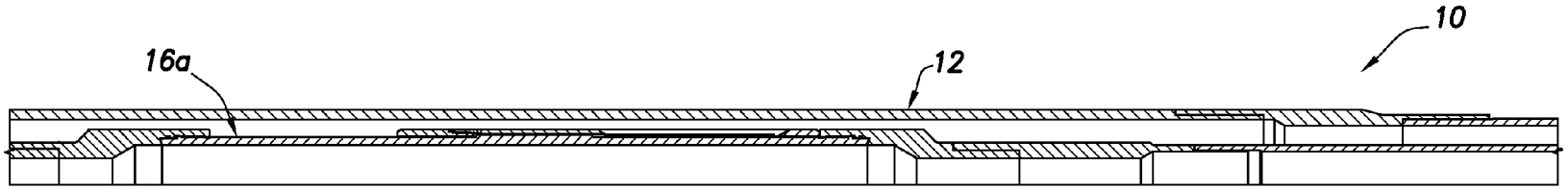
Figure 4H:
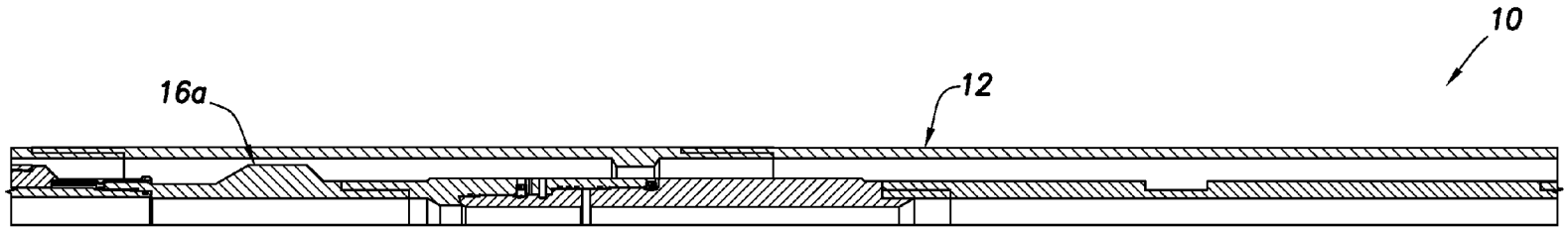
Figure 4I:
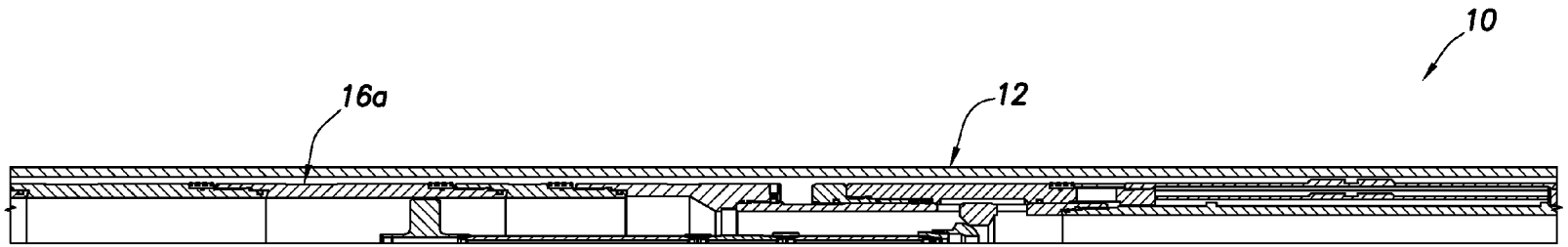
Figure 4J:
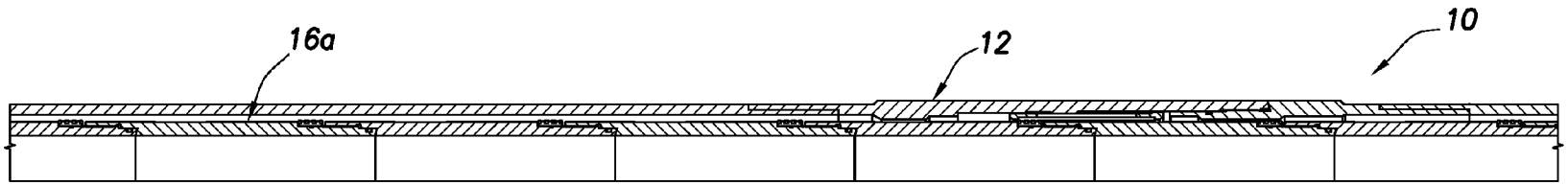
Figure 4K:
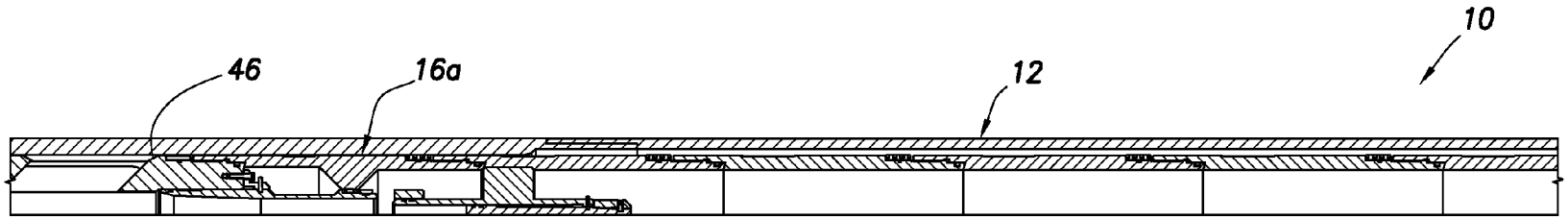
Figure 4L:
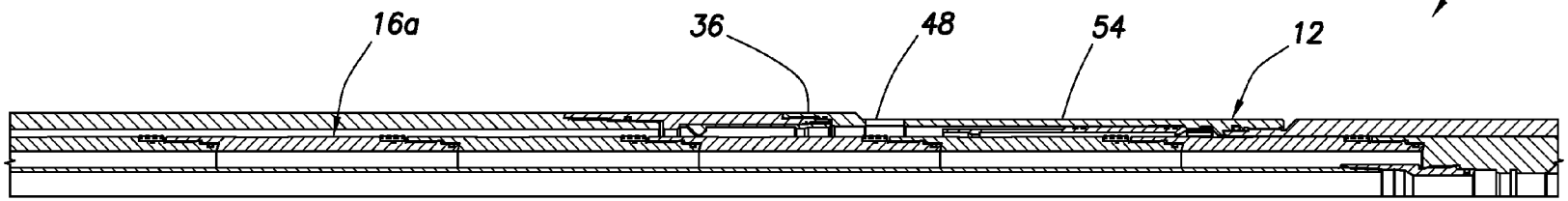
Figure 4M:
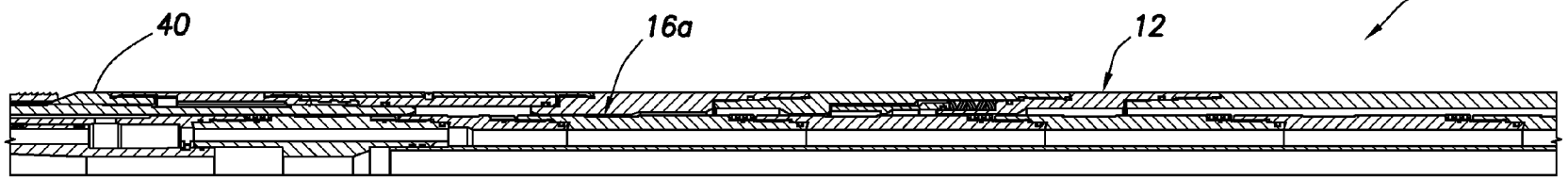
Figure 4N:
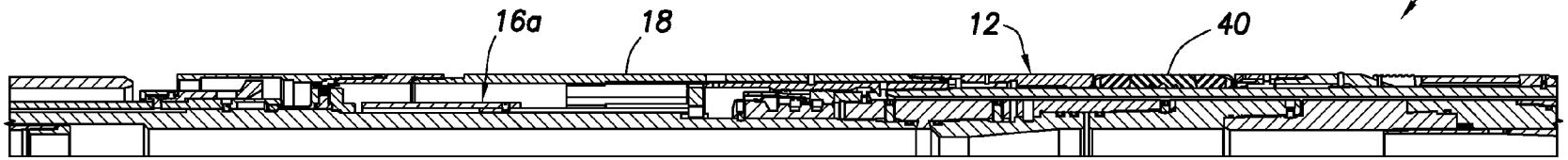
Figure 4O:
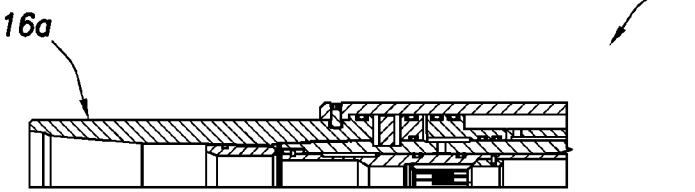

The assembly 12 and work string **16*a* are depicted in FIGS. 4A-O in a run-in configuration, that is, in a configuration in which they are initially conveyed into the wellbore 14. The assembly 12 is releasably attached to the work string 16*a* until the packer 40** is set, after which the work string is released for reciprocal displacement relative to the assembly.

Figure 5A:
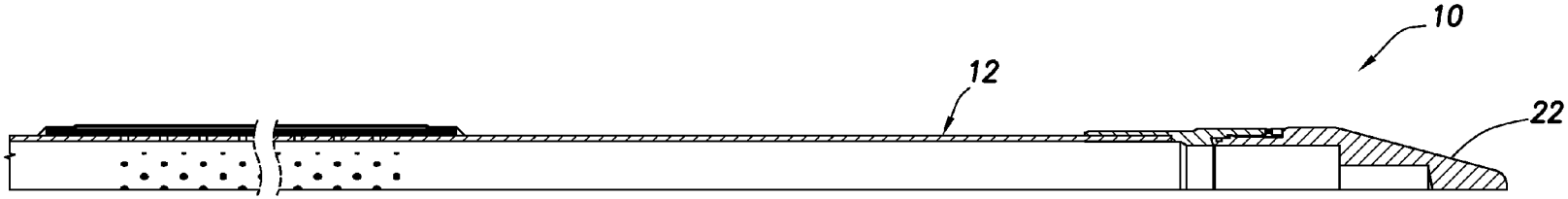
FIGS. 5A-P are schematic quarter-sectional views of the gravel packing assembly and the work string in a packer test configuration.
Figure 5B:
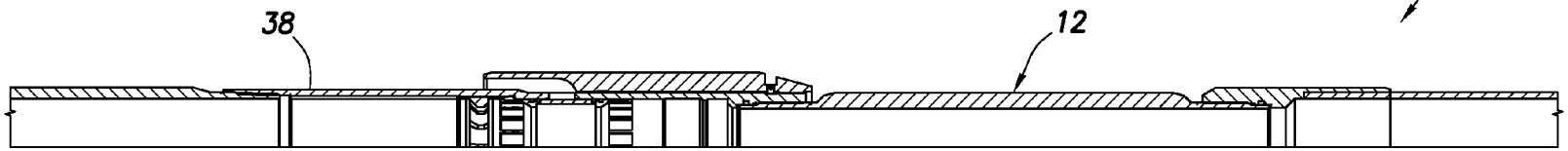
Figure 5C:
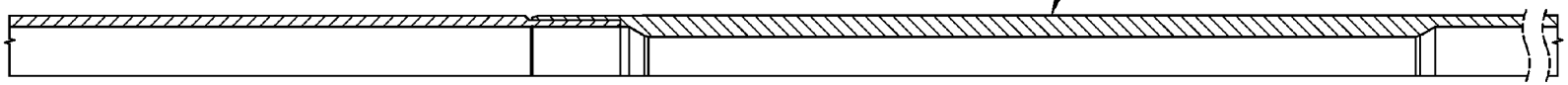
Figure 5D:
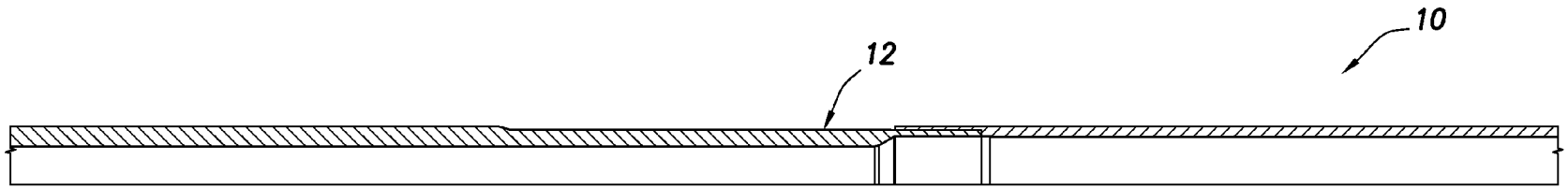
Figure 5E:
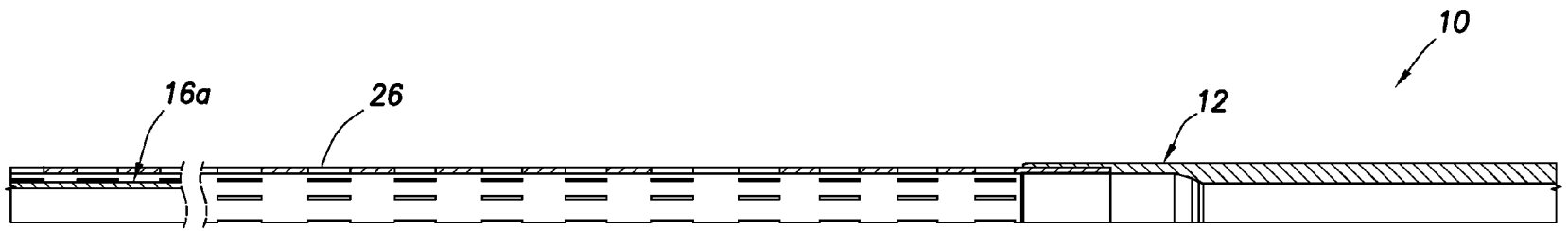
Figure 5F:
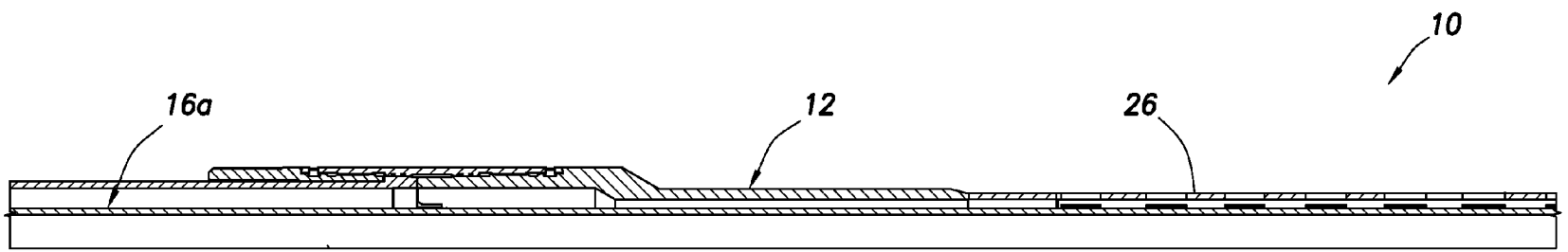
Figure 5G:
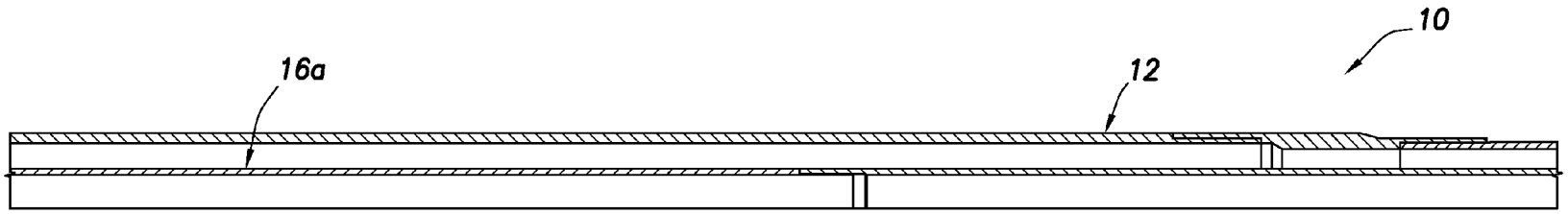
Figure 5H:
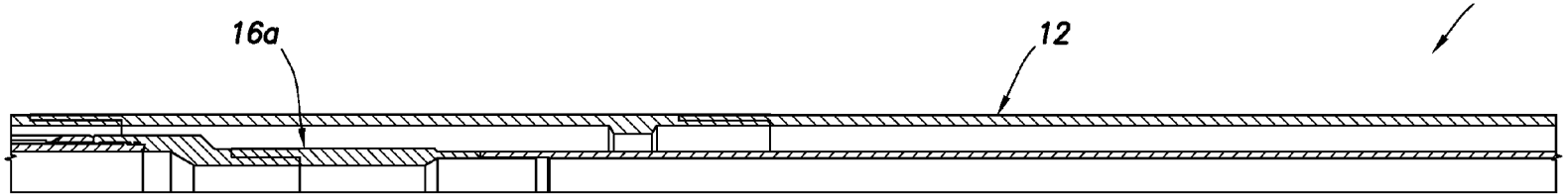
Figure 5I:
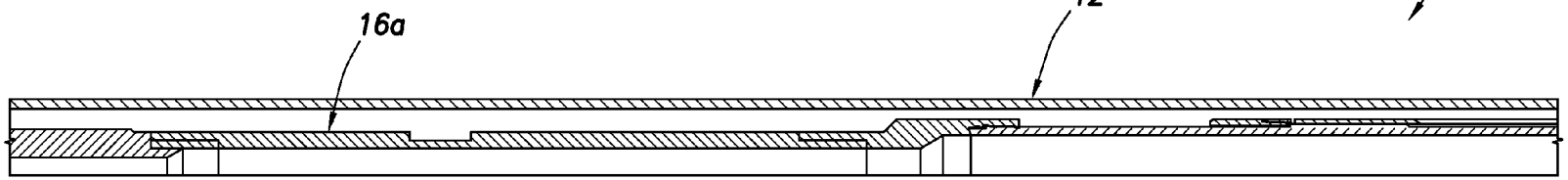
Figure 5J:
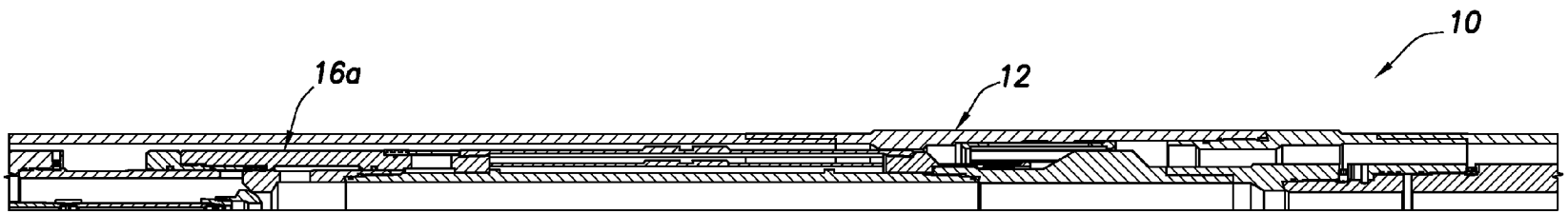
Figure 5K:
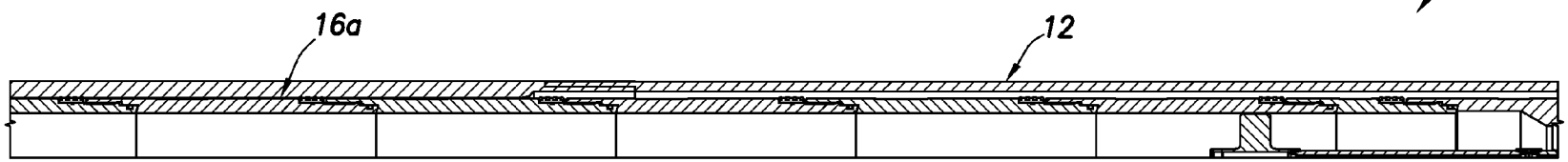
Figure 5L:
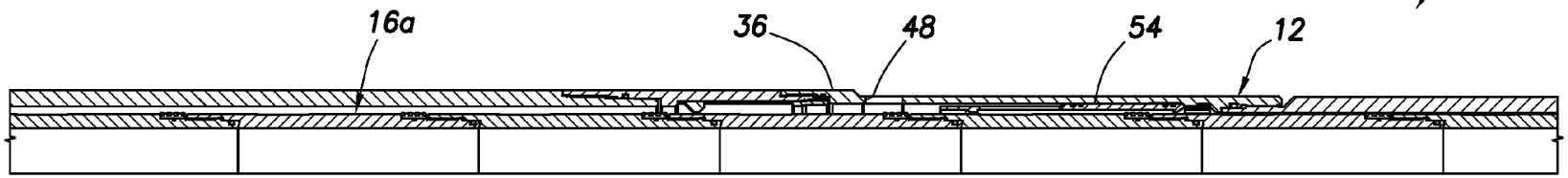
Figure 5M:
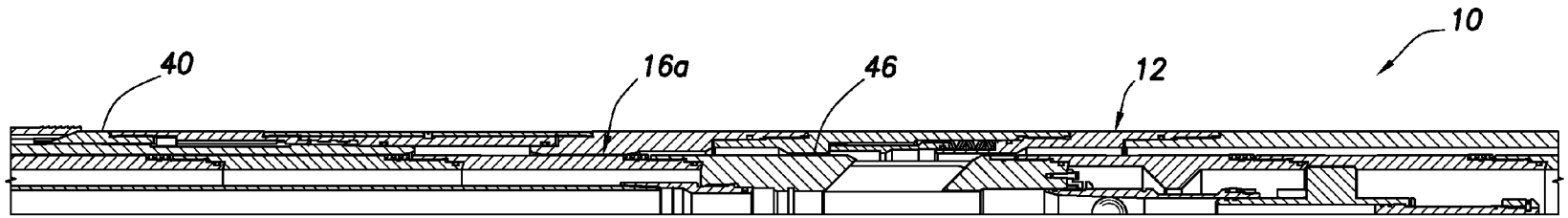
Figure 5N:
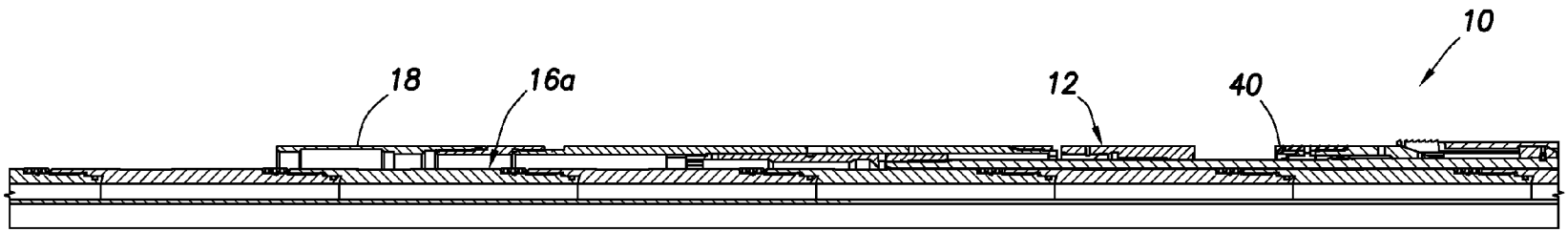
Figure 5O:
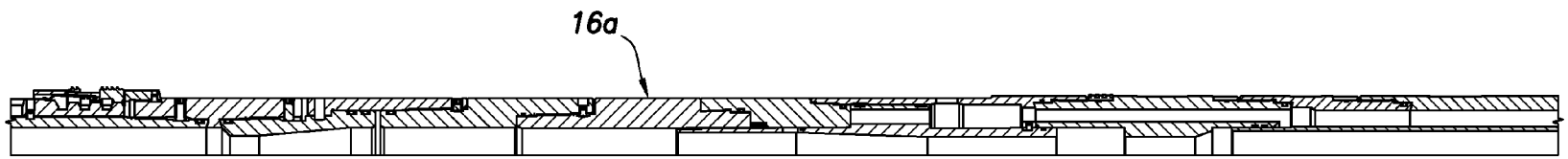
Figure 5P:
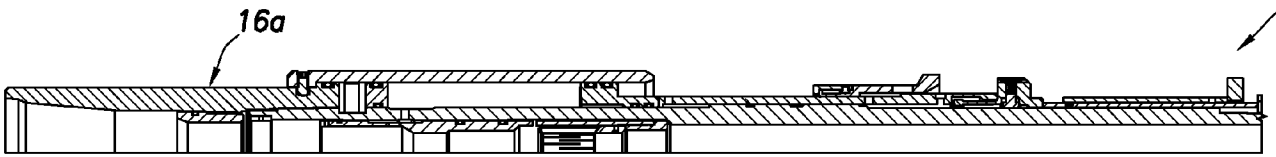

In FIGS. 5A-P, the assembly 12 and work string **16*a* are depicted in a packer test configuration. The packer 40 has been set using internally applied pressure, and the work string 16*a*** has been raised to provide a fluid communication path for testing the packer.

Figure 6A:
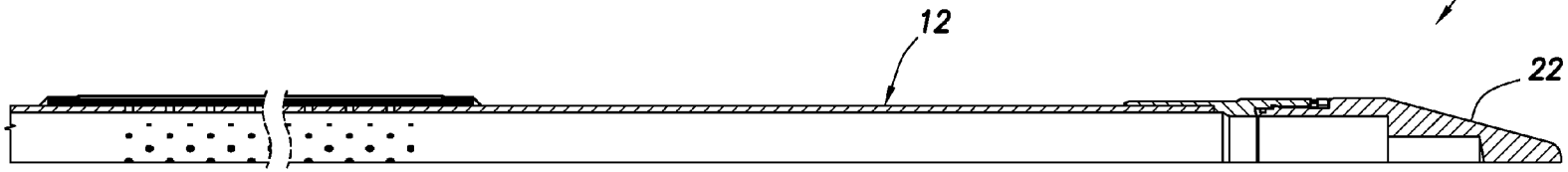
FIGS. 6A-P are schematic quarter-sectional views of the gravel packing assembly and the work string in a circulate configuration.
Figure 6B:
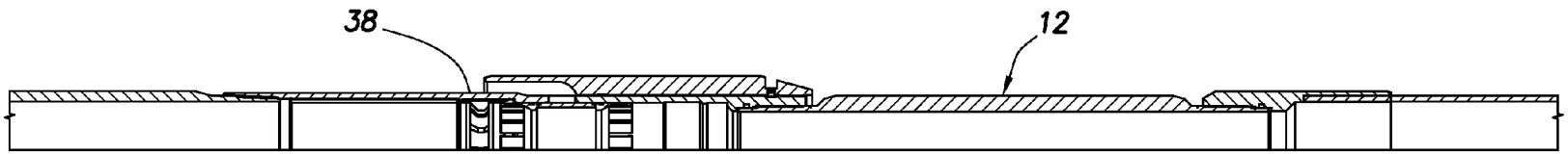
Figure 6C:
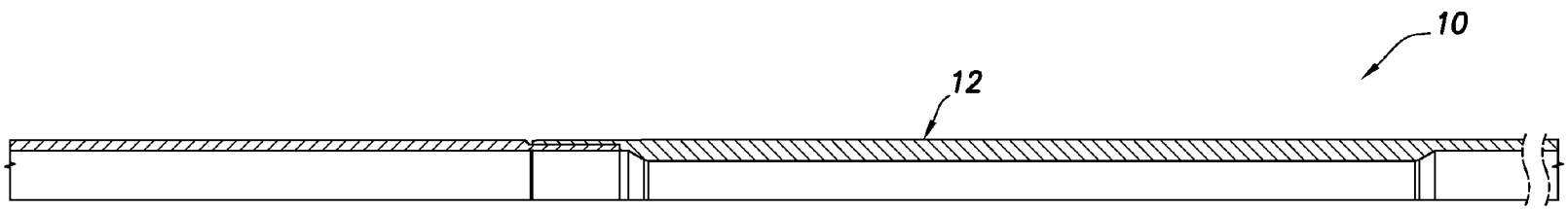
Figure 6D:
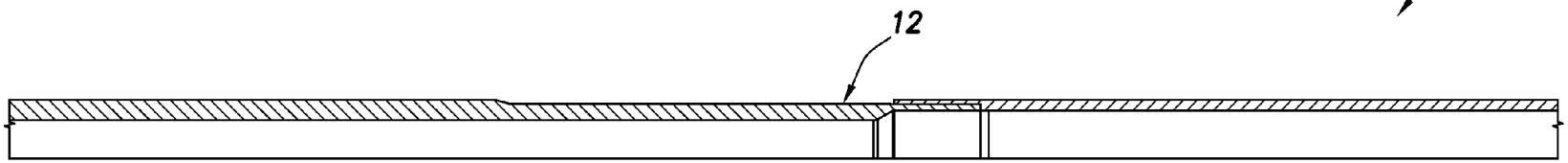
Figure 6E:
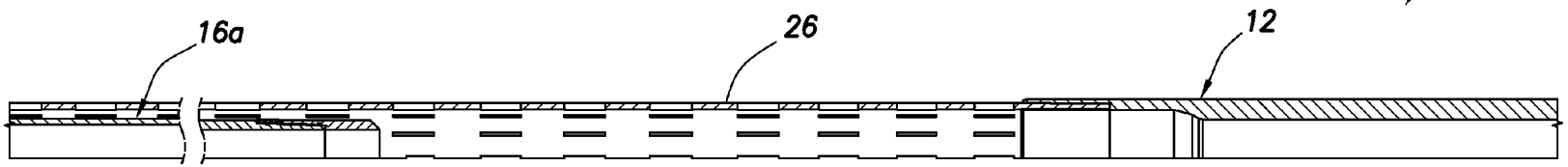
Figure 6F:
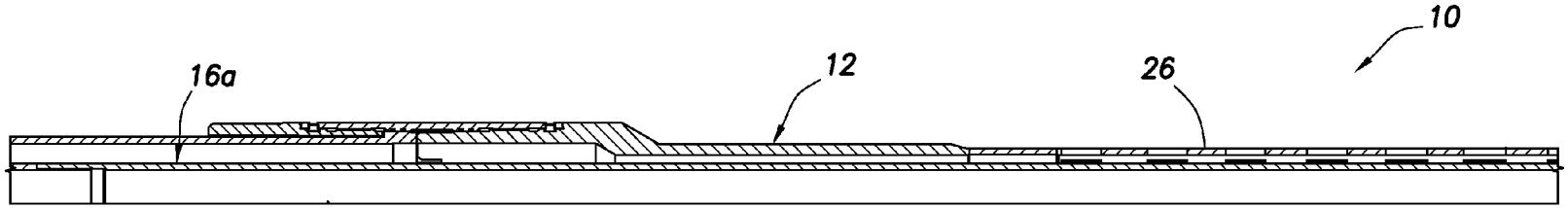
Figure 6G:
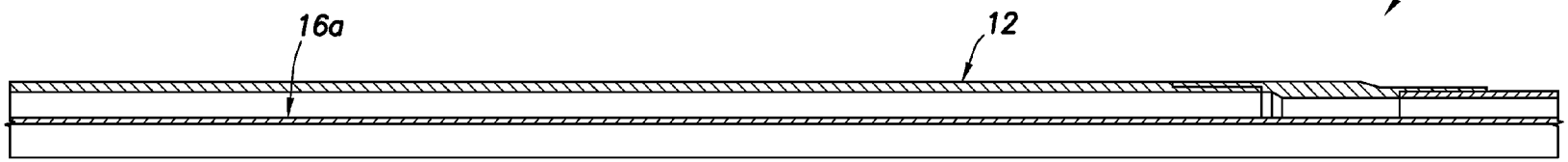
Figure 6H:
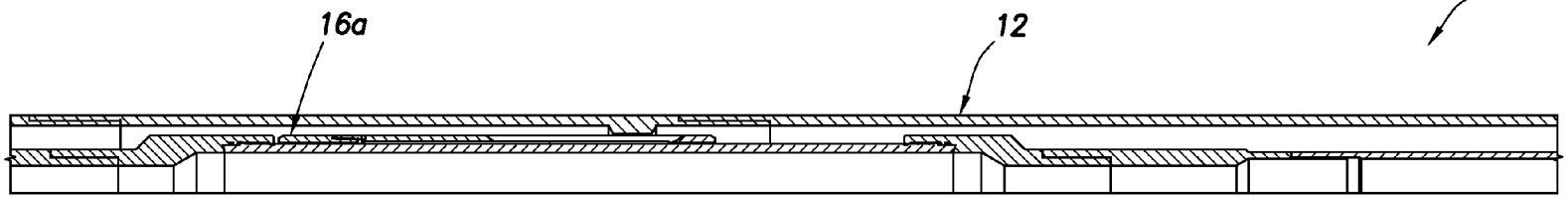
Figure 6I:
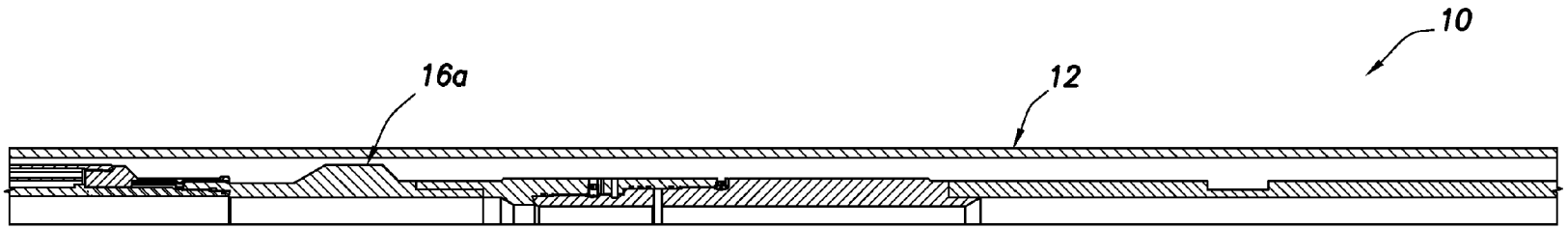
Figure 6J:
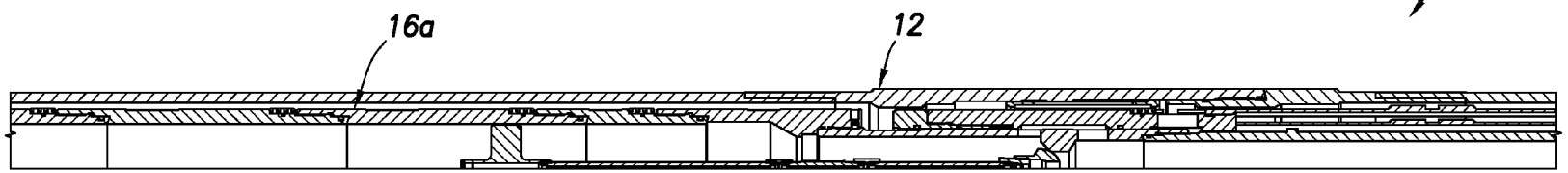
Figure 6K:
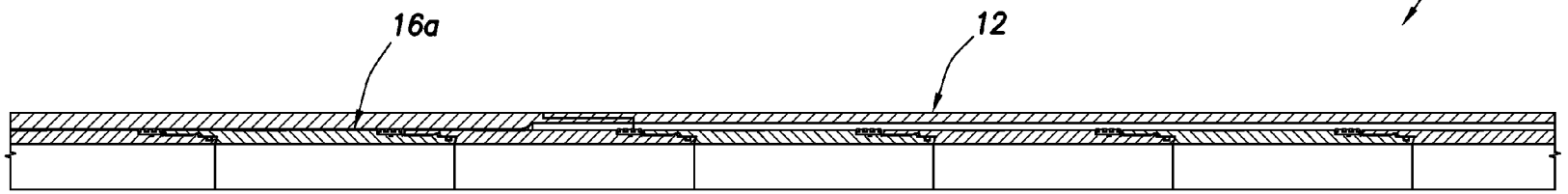
Figure 6L:
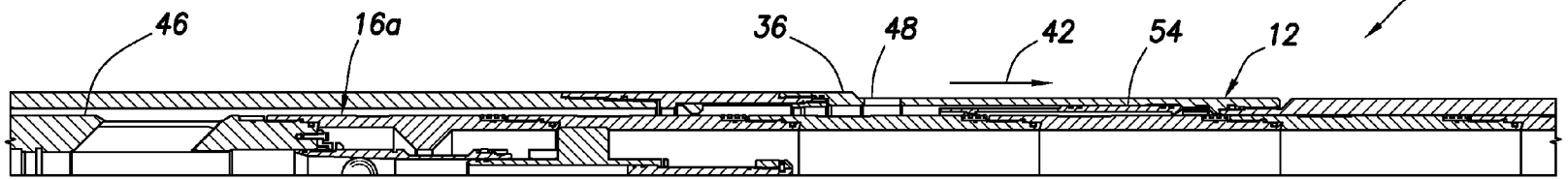
Figure 6M:
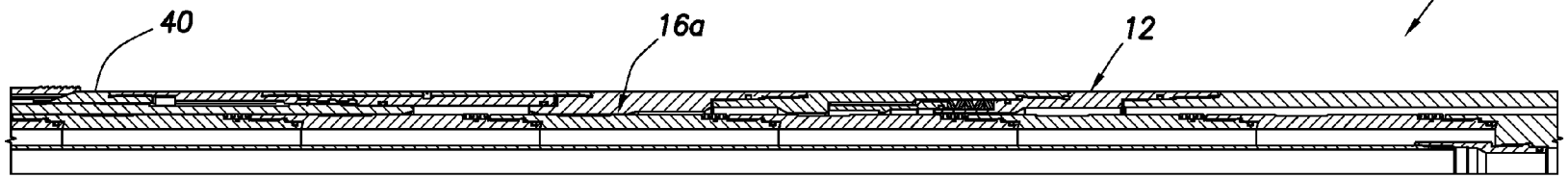
Figure 6N:
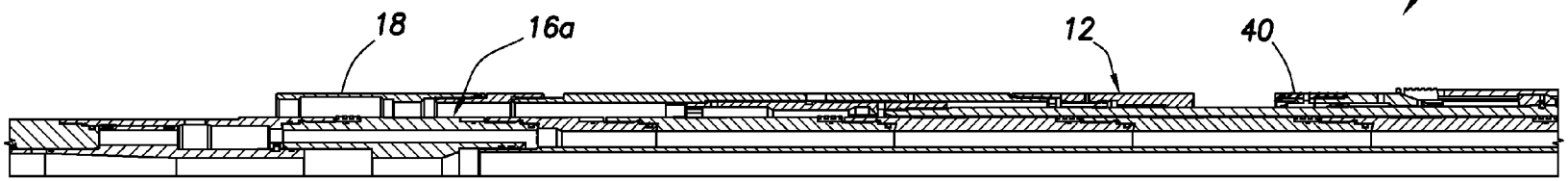
Figure 6O:
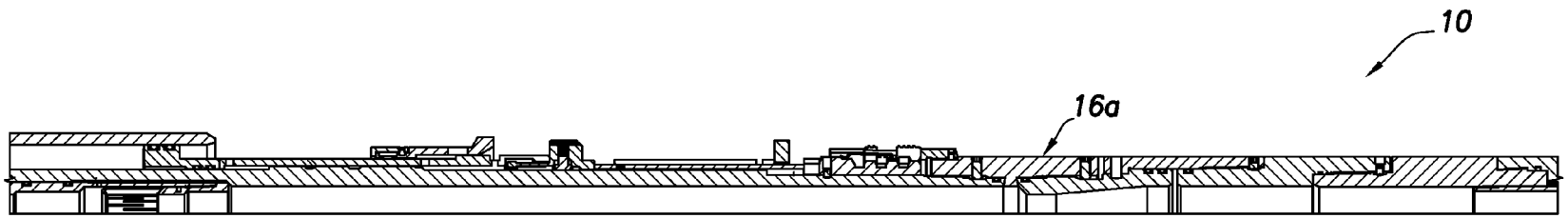
Figure 6P:
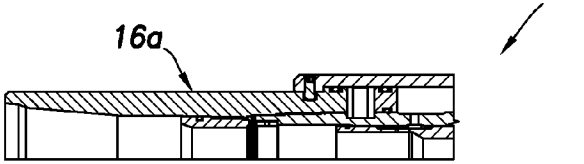

In FIGS. 6A-P, the assembly 12 and work string 16*a* are depicted in a circulate configuration. The work string 16*a* has been lowered somewhat from its packer test configuration to provide for circulation of fluid downward through the work string and upward to the surface through an annulus 50 formed between the work string and the wellbore 14 above the packer 40.

The work string 16*a* is then lowered again somewhat to position a crossover 46 opposite ports 48 in the upper flow control device 36. The slurry 42 can then be discharged from the assembly 12 (via the crossover 46 and the ports 48 in the flow control device 36) in the direction indicated in FIG. 6L.

Figure 7A:
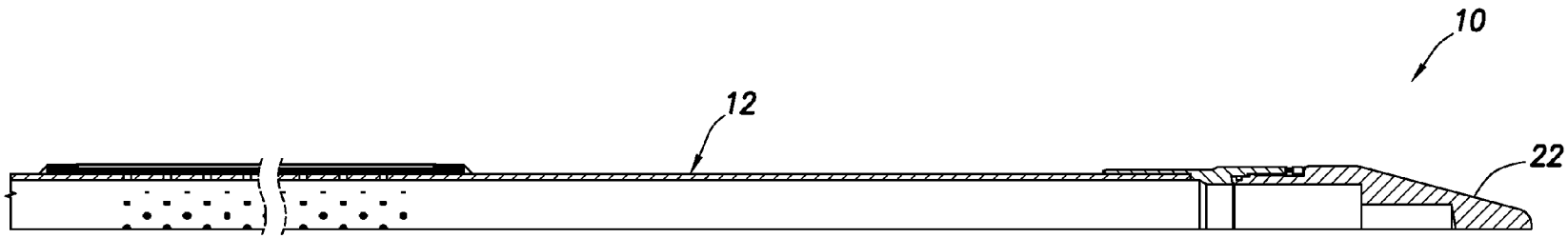
FIGS. 7A-Q are schematic quarter-sectional views of the gravel packing assembly and the work string in a reverse flow configuration.
Figure 7B:
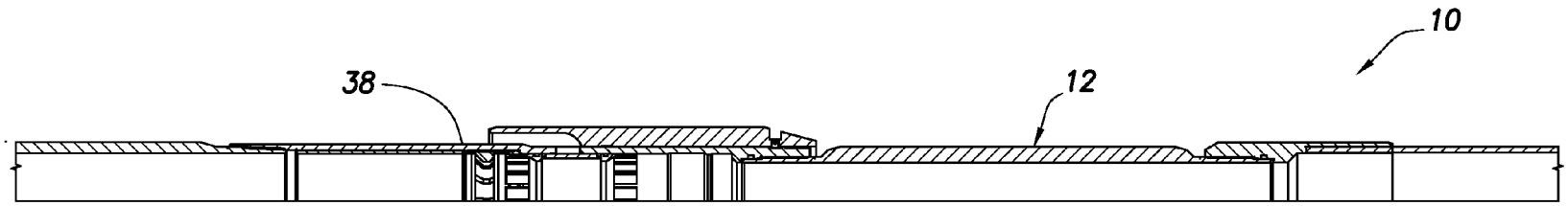
Figure 7C:
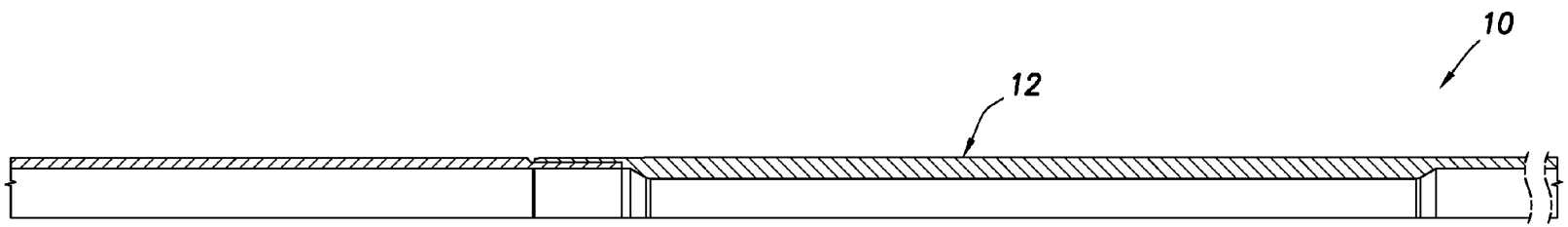
Figure 7D:
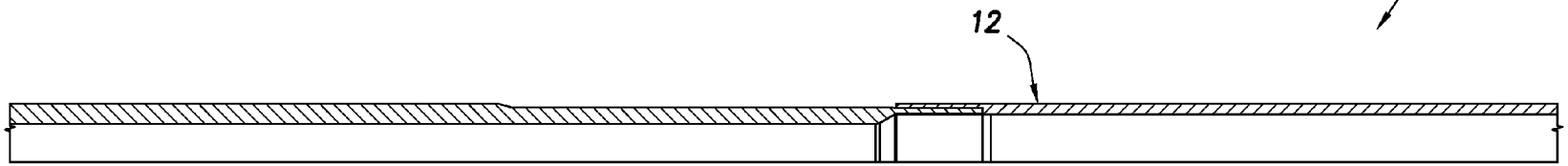
Figure 7E:
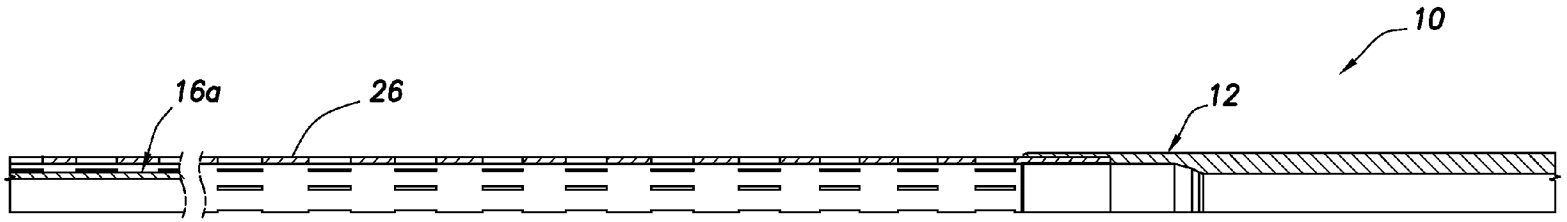
Figure 7F:
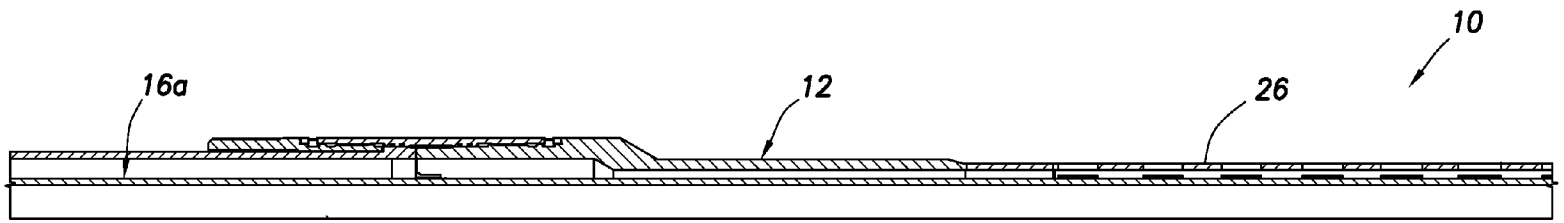
Figure 7G:
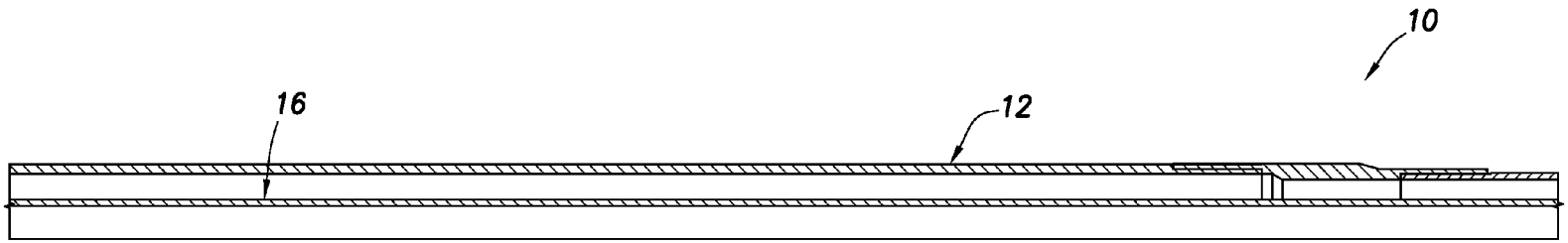
Figure 7H:
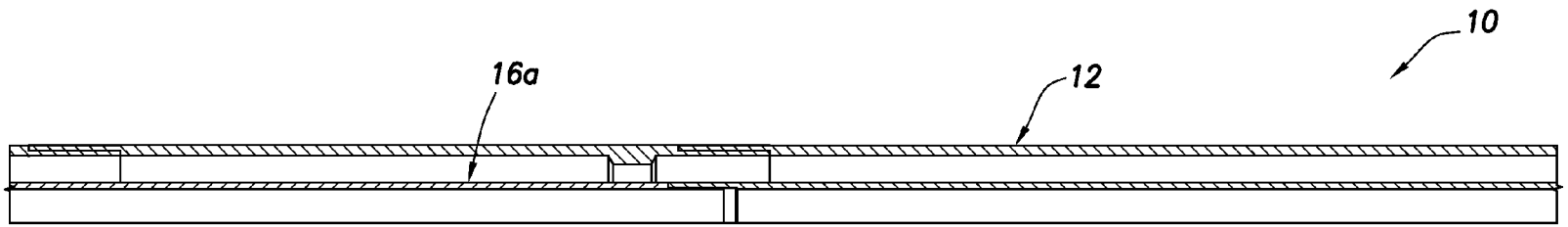
Figure 7I:
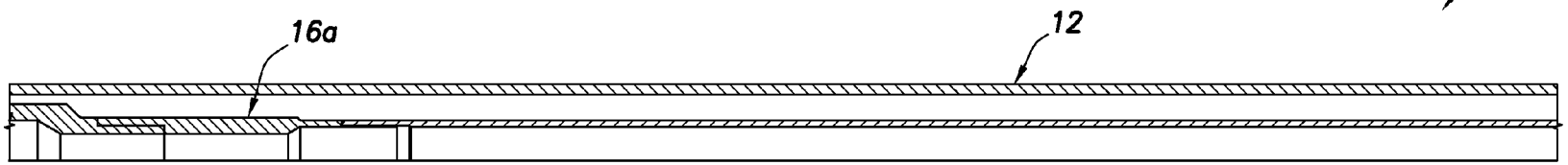
Figure 7J:
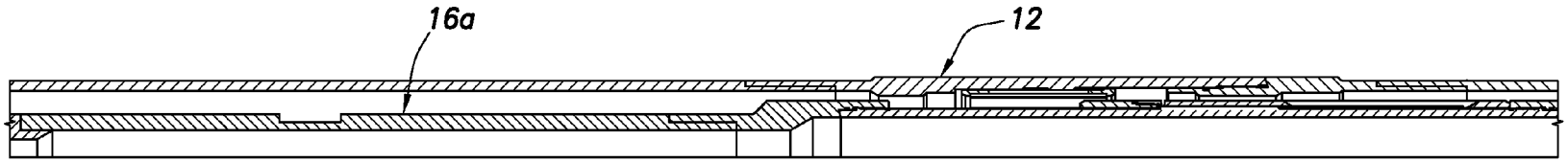
Figure 7K:
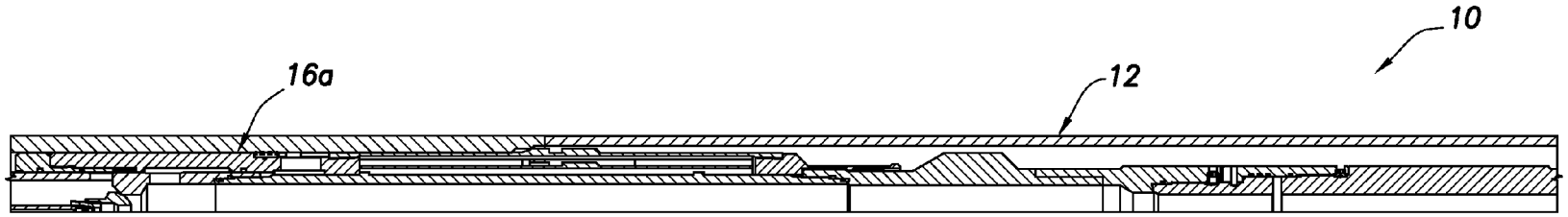
Figure 7L:
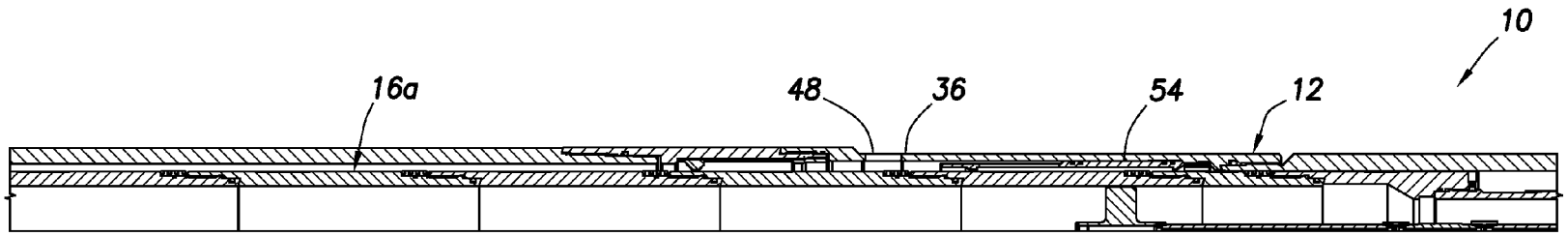
Figure 7M:
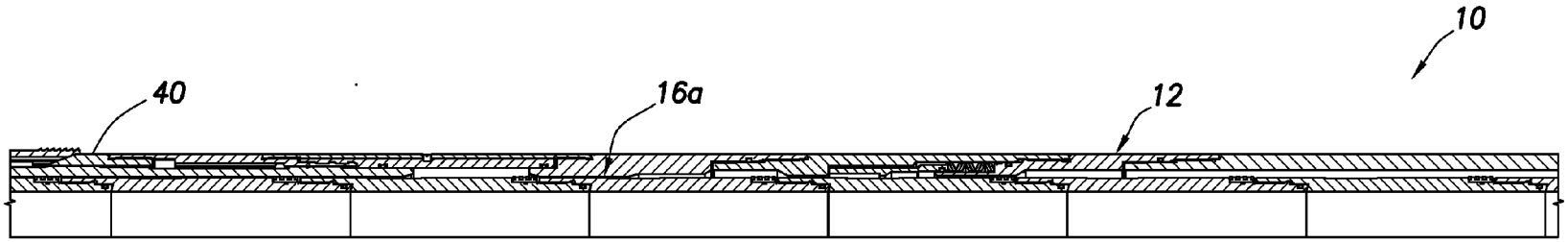
Figure 7N:
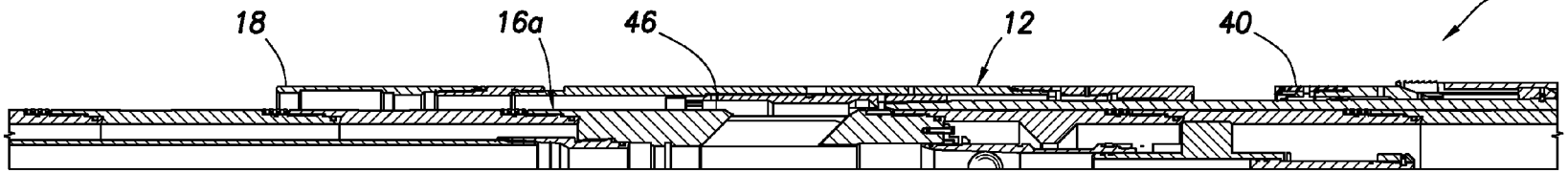
Figure 7O:
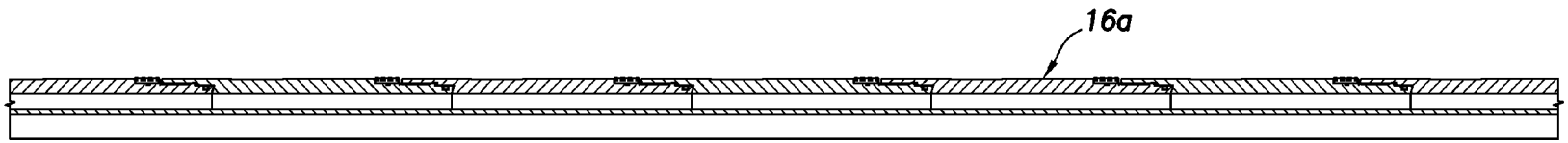
Figure 7P:
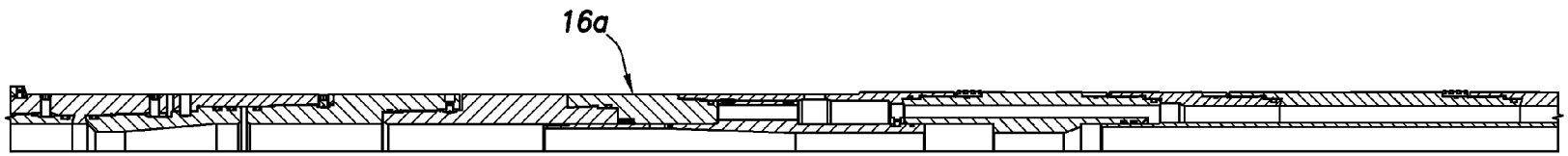
Figure 7Q:
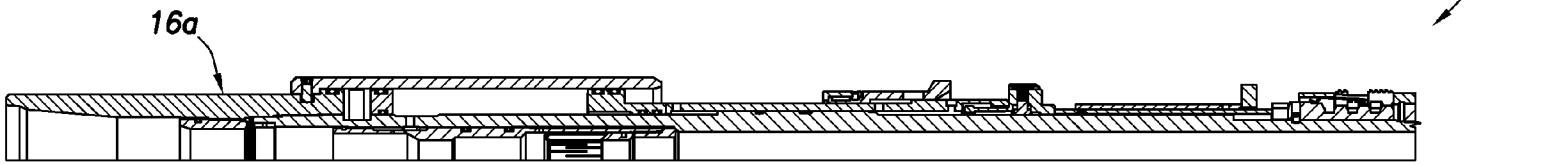

In FIGS. 7A-Q, the work string 16*a* has been raised to a reverse circulate position. In this configuration of the work string 16*a* and assembly 12, fluid may be circulated down the annulus 50 and up the work string 16*a* to clear the slurry from the work string.

Figure 8A:
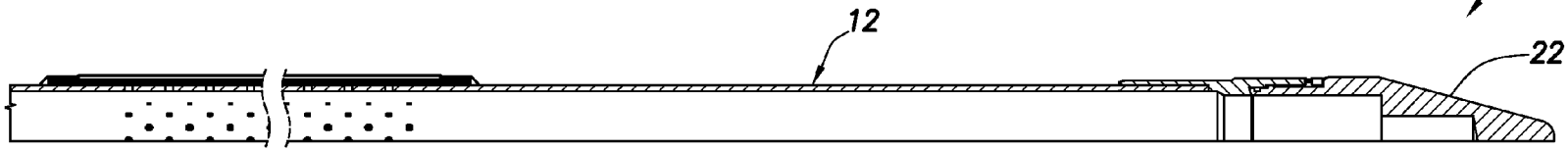
FIGS. 8A-S are schematic quarter-sectional views of the gravel packing assembly and the work string in an acid wash configuration.
Figure 8B:
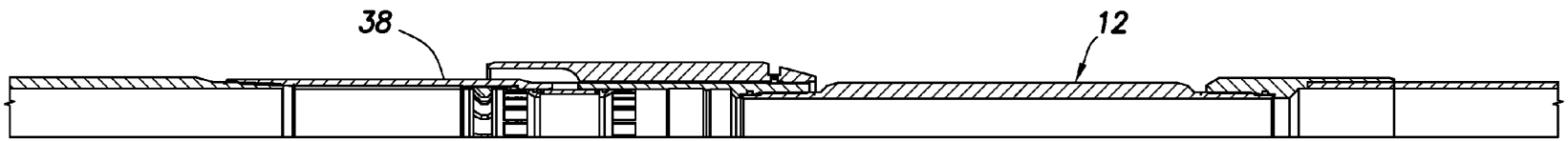
Figure 8C:
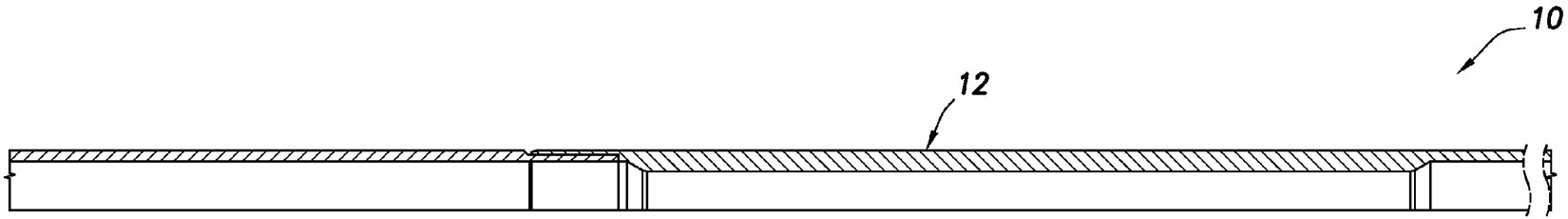
Figure 8D:
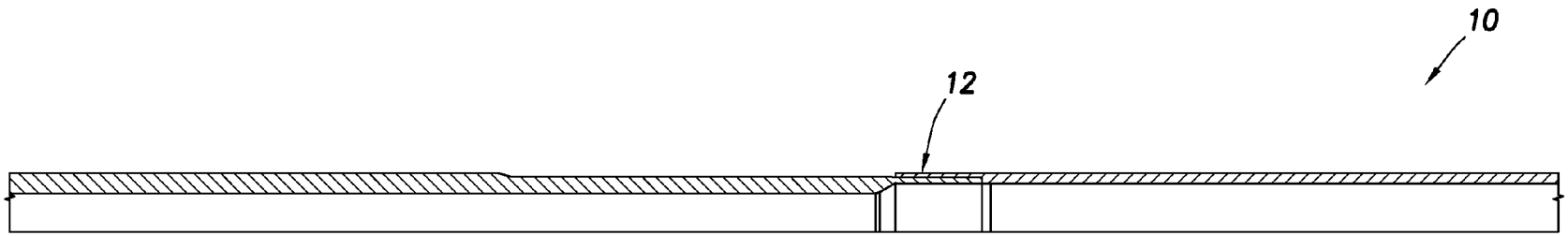
Figure 8E:
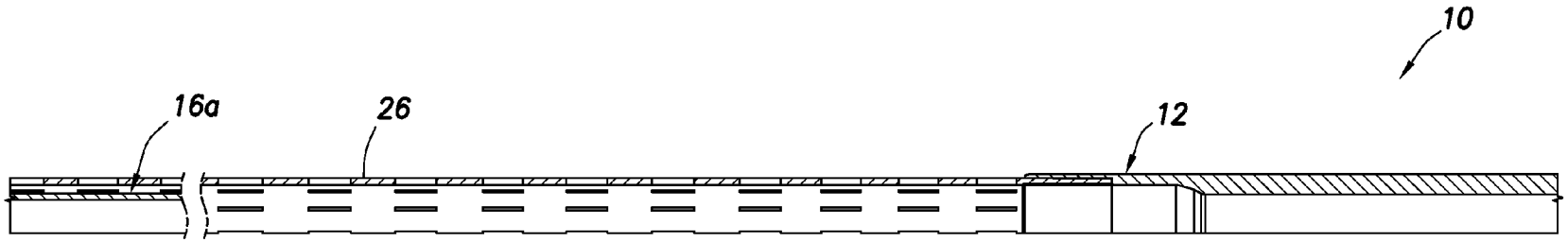
Figure 8F:
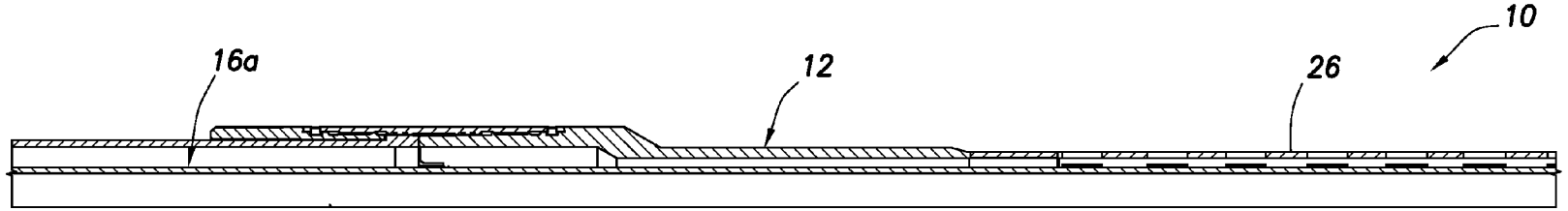
Figure 8G:
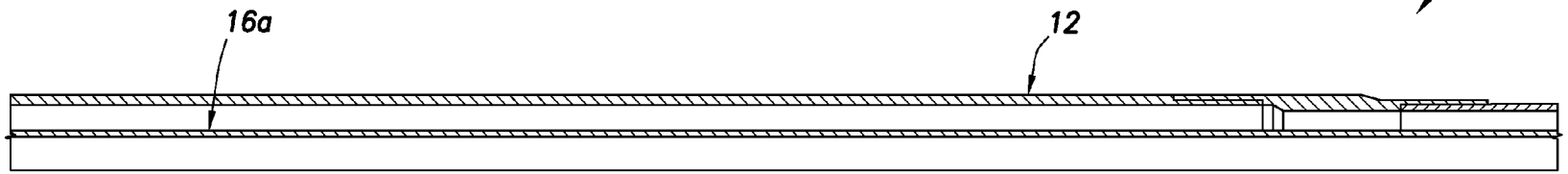
Figure 8H:
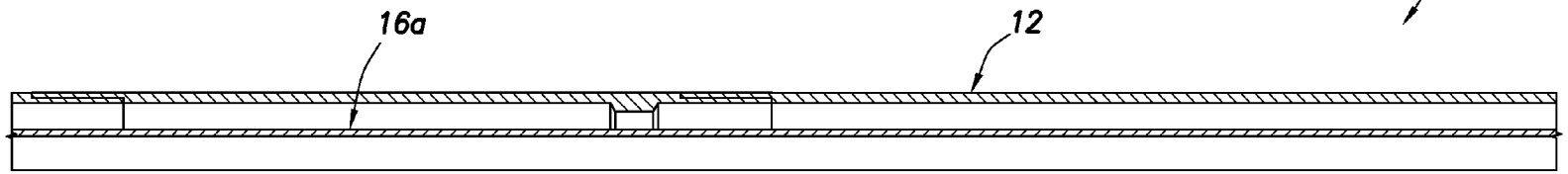
Figure 8I:
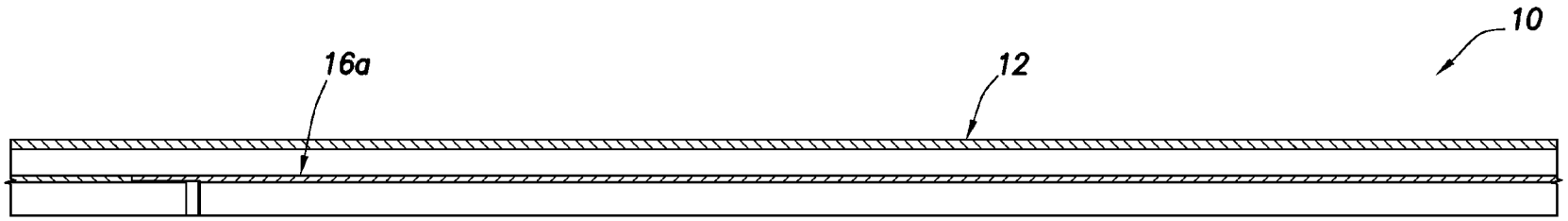
Figure 8J:
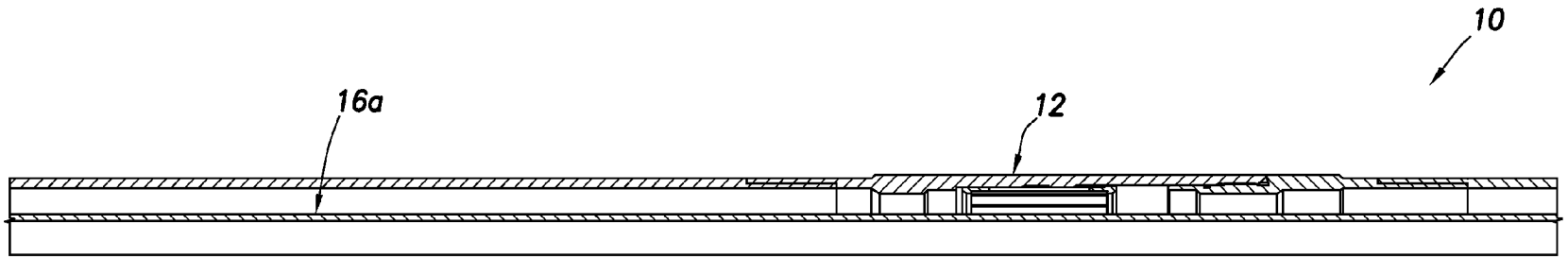
Figure 8K:
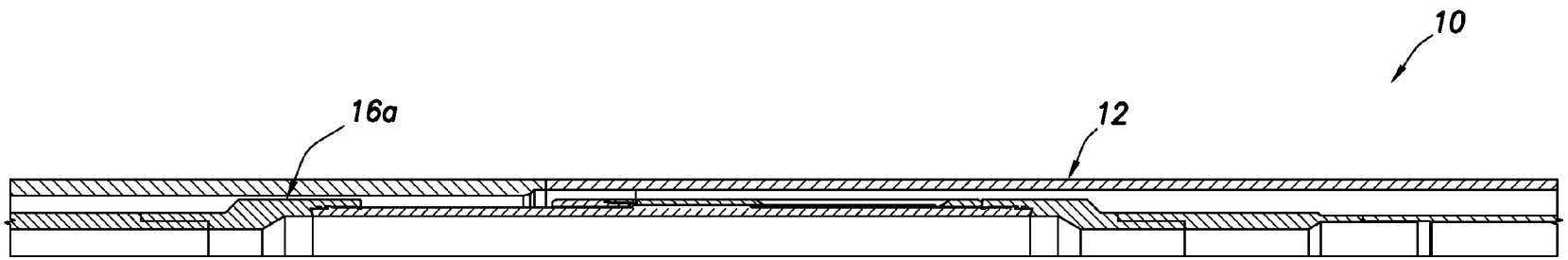
Figure 8L:
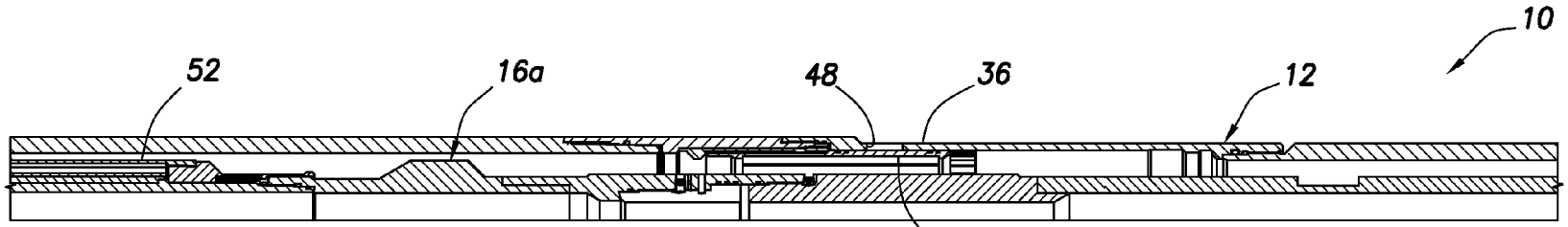
Figure 8M:
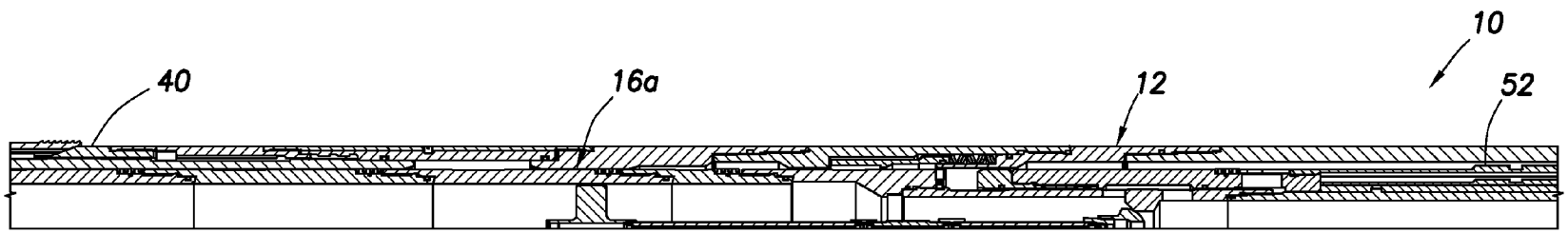
Figure 8N:
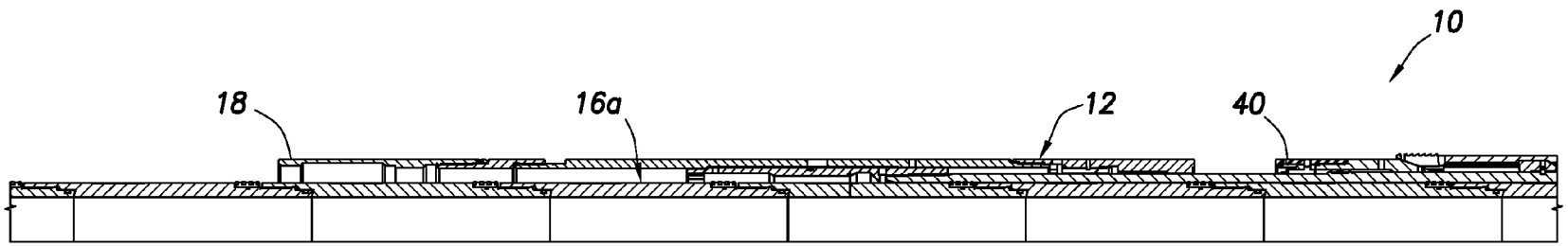
Figure 8O:
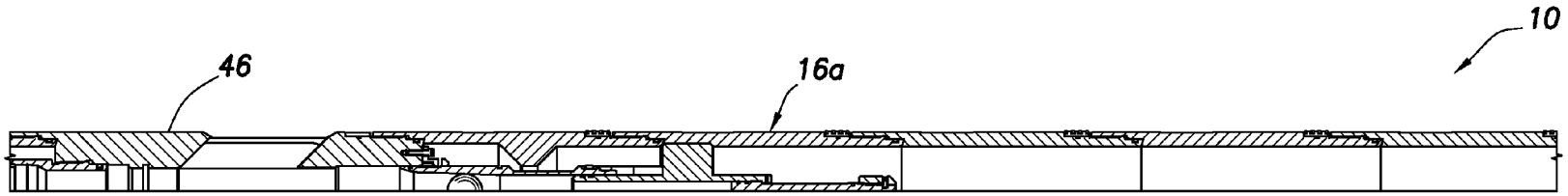
Figure 8P:
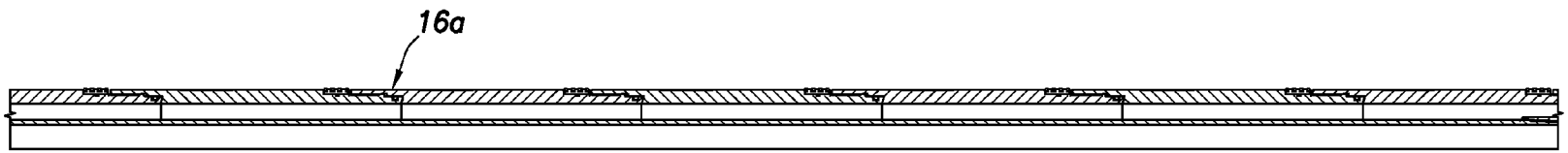
Figure 8Q:
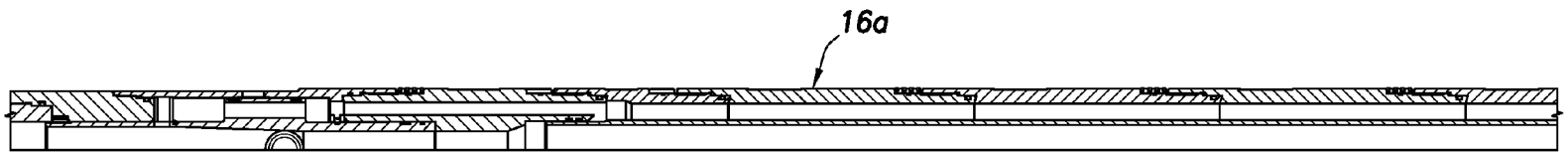
Figure 8R:
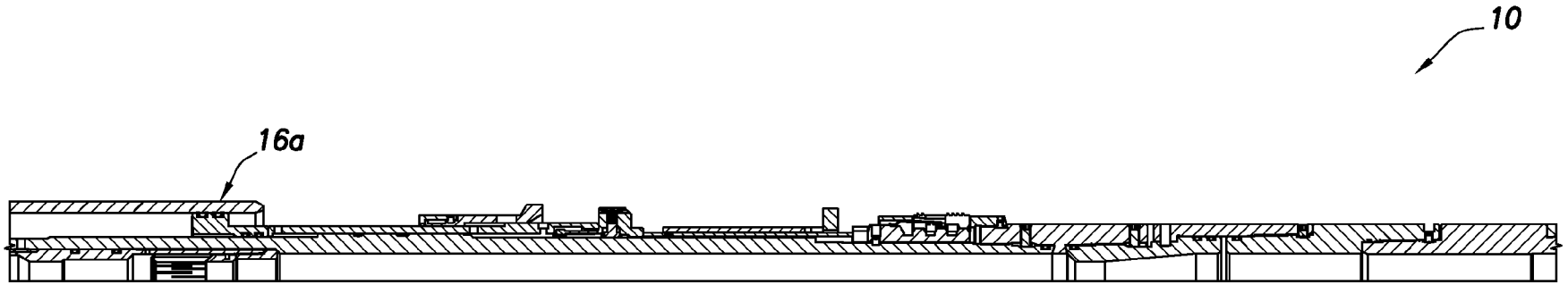
Figure 8S:
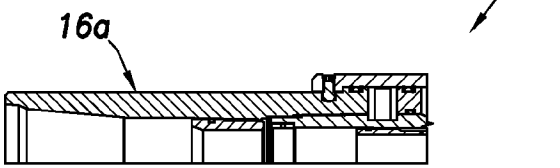

In FIGS. 8A-S, the work string 16*a* and assembly 12 are in an optional acid wash configuration. The work string 16*a* has been raised again, thereby causing a shifting tool 52 to close a sleeve 54 of the flow control device 36.

Note that, in the configurations of FIGS. 4A-7Q, the flow control device 36 is open. In addition, in the configurations of FIGS. 4A-8S, the flow control device 38 is closed.

Figure 9A:
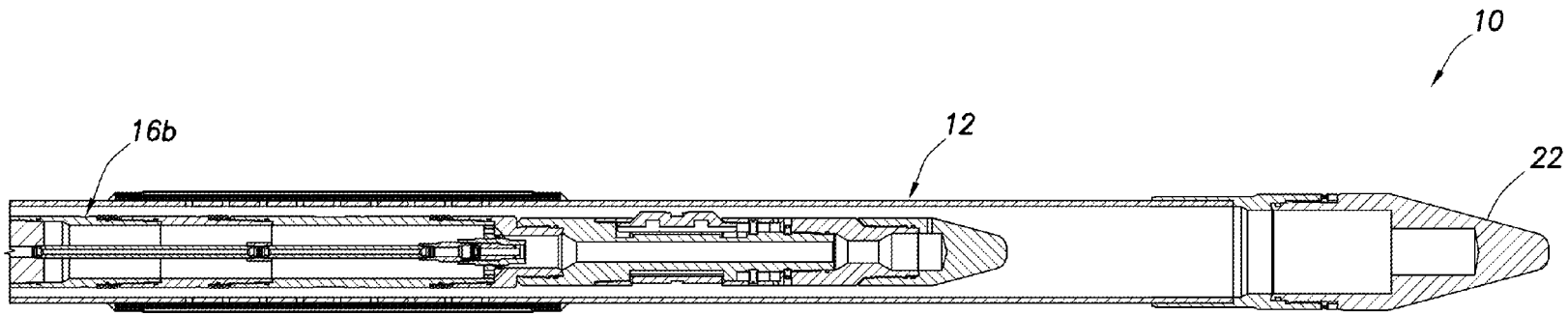
FIGS. 9A-N are schematic cross-sectional views of the gravel packing assembly and another work string in a circulate configuration.
Figure 9B:
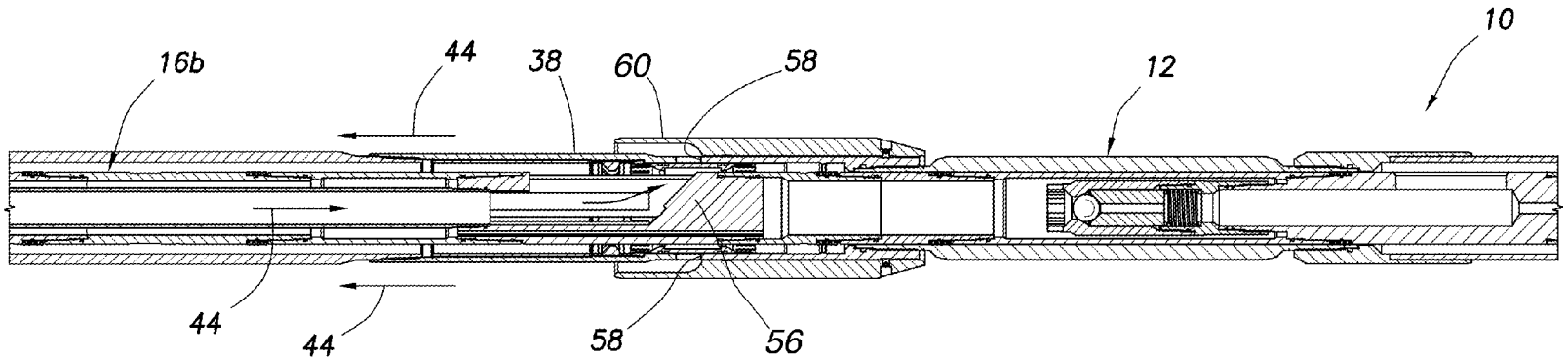
Figure 9C:
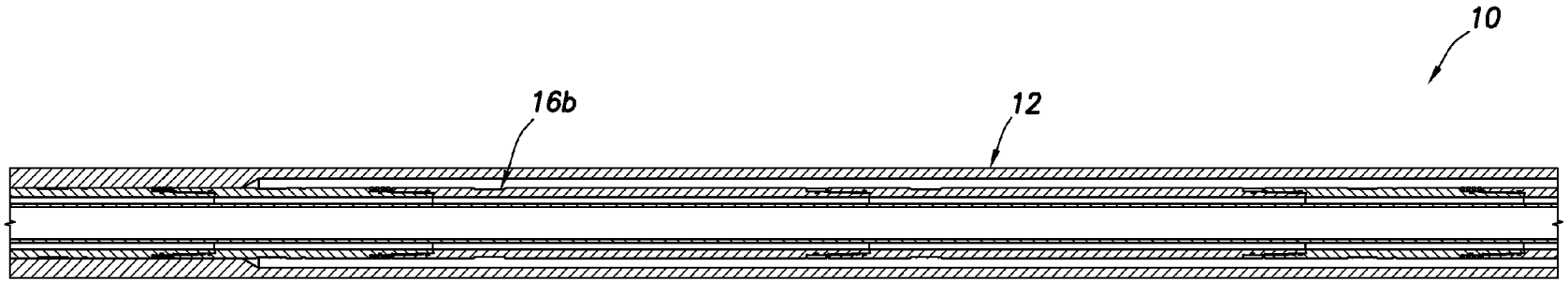
Figure 9D:
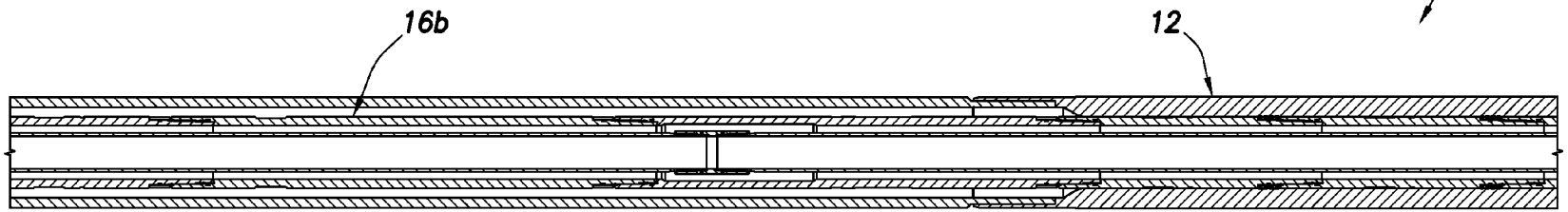
Figure 9E:
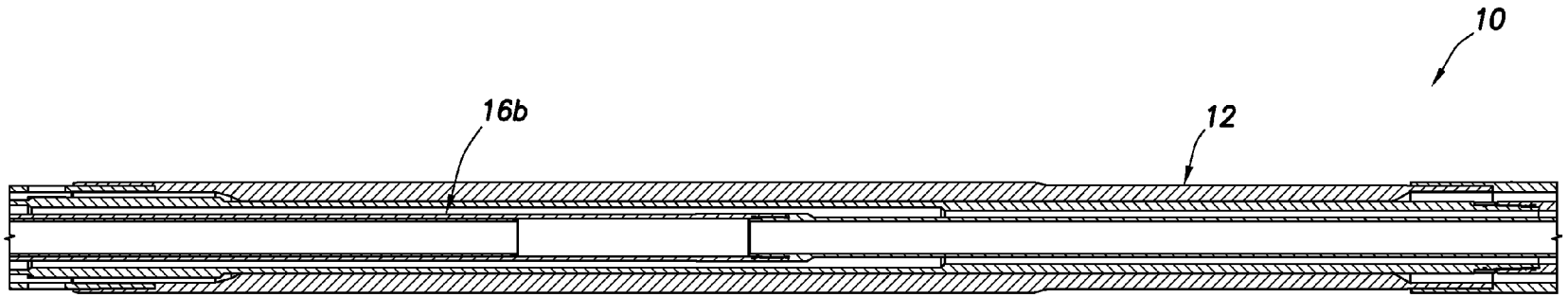
Figure 9F:
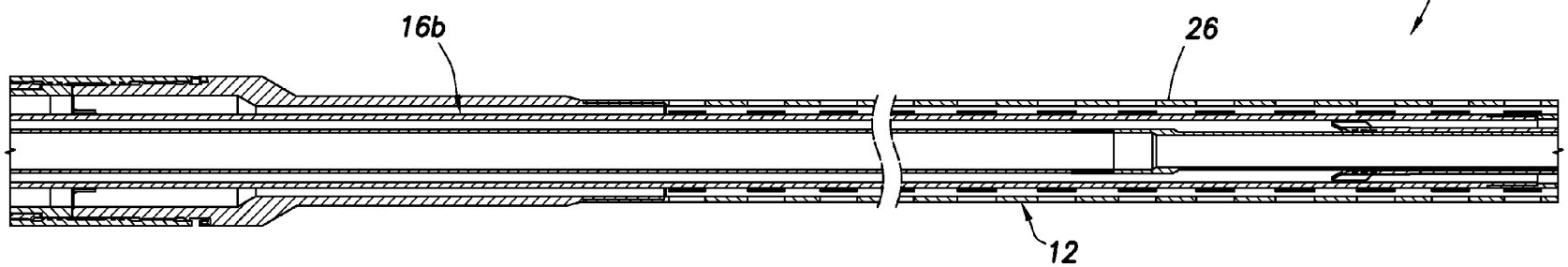
Figure 9G:
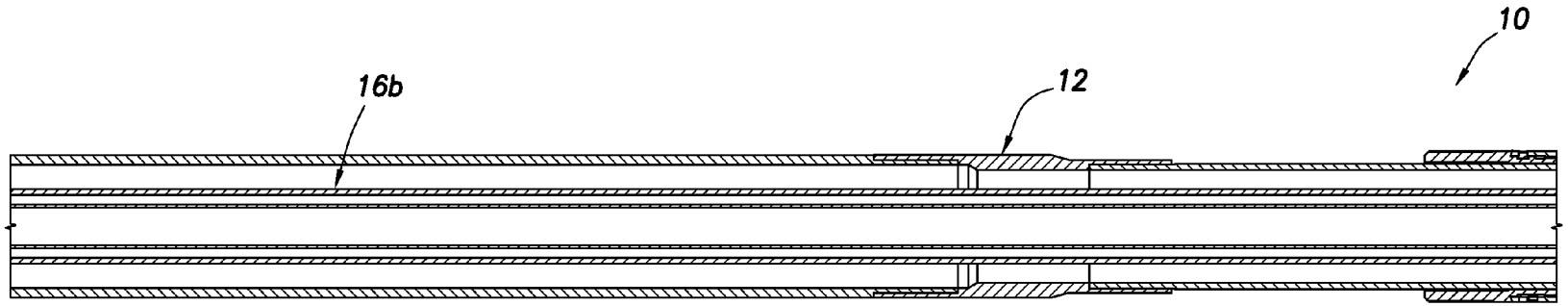
Figure 9H:
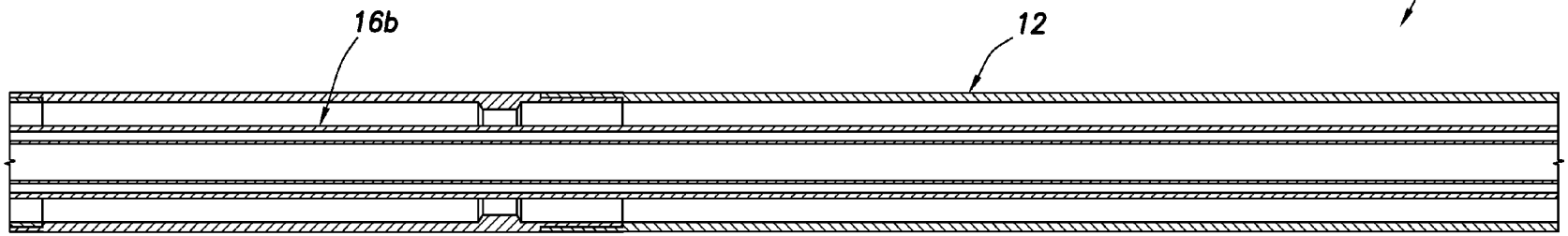
Figure 9I:
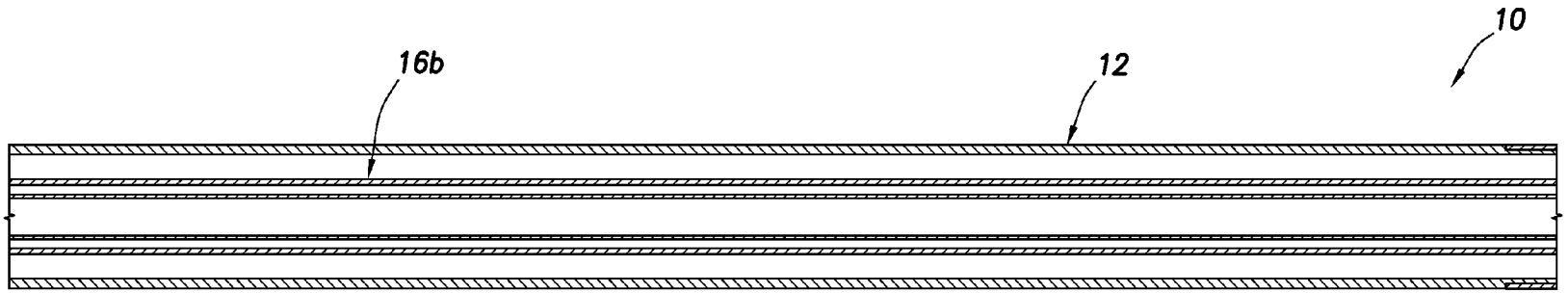
Figure 9J:
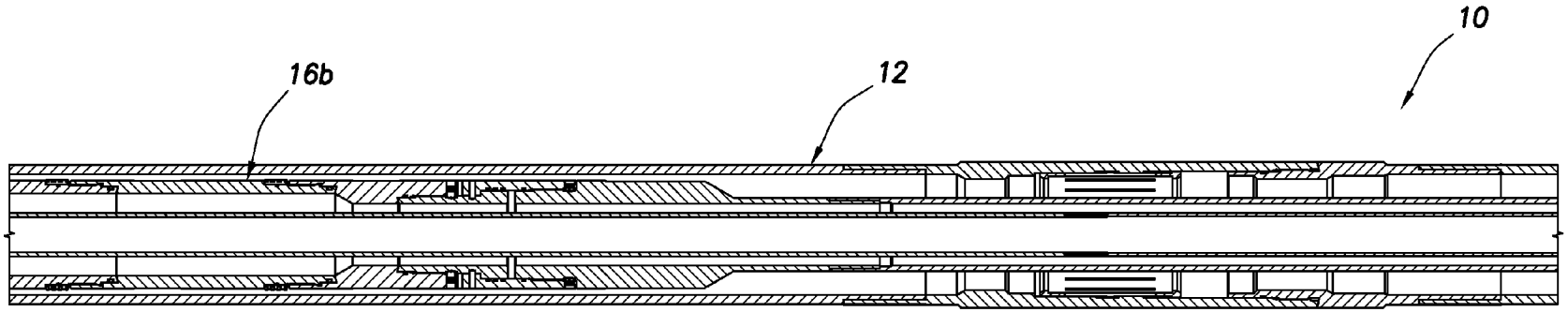
Figure 9K:
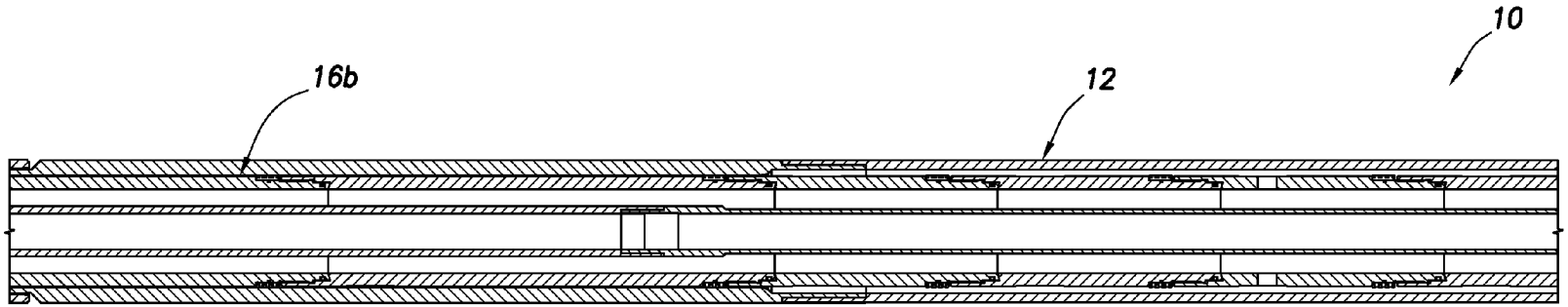
Figure 9L:
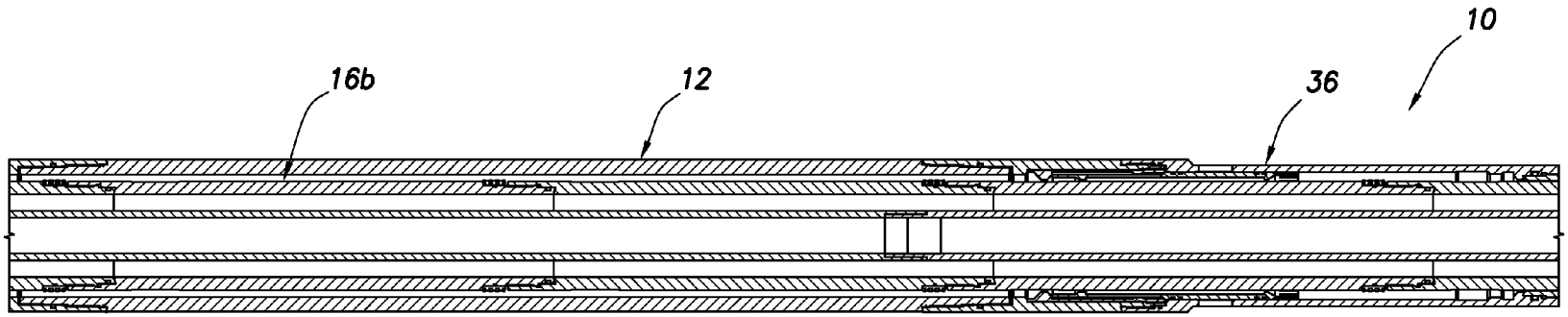
Figure 9M:
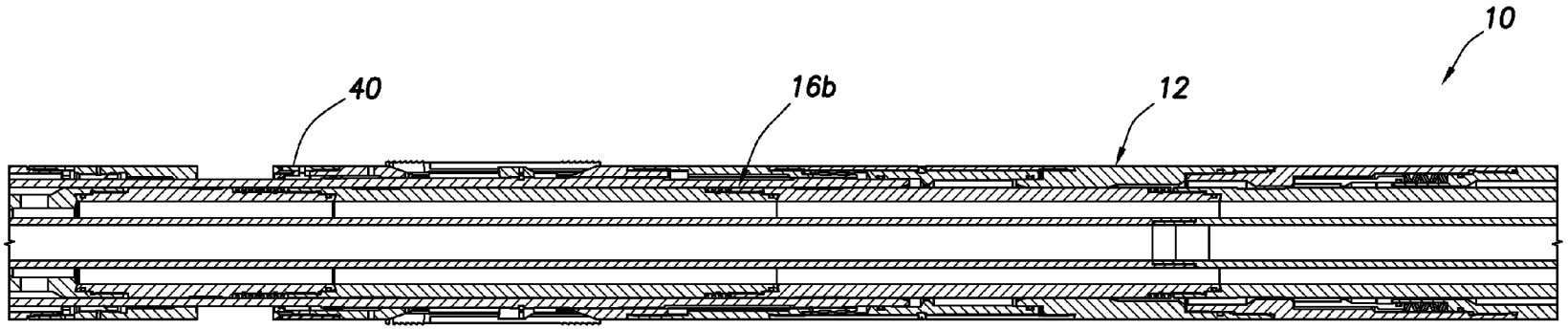
Figure 9N:
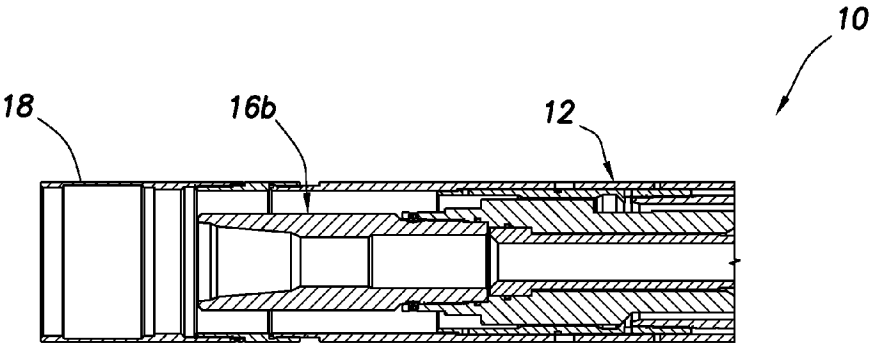

The work string 16*a* is then retrieved from the well, and the other work string 16*b* is conveyed into the well and inserted into the assembly 12. In FIGS. 9A-N, the work string 16*b* is positioned so that a crossover 56 is opposite ports 58 of the lower flow control device 38 (see FIG. 9B). The gravel slurry 44 can then be discharged from the assembly 12 (via the crossover 56 and the ports 58 in the flow control device 38) to the annulus 32 in the direction shown in FIG. 9B.

An outer shroud 60 outwardly overlies the ports 58. The shroud 60 prevents undue erosion of the wellbore 14 surrounding the flow control device 38 as the slurry 44 exits the ports 58. Use of the shroud 60 is not necessary in keeping with the principles of this disclosure, since the assembly 12 could be provided without the shroud overlying the ports 58.

Figure 10A:
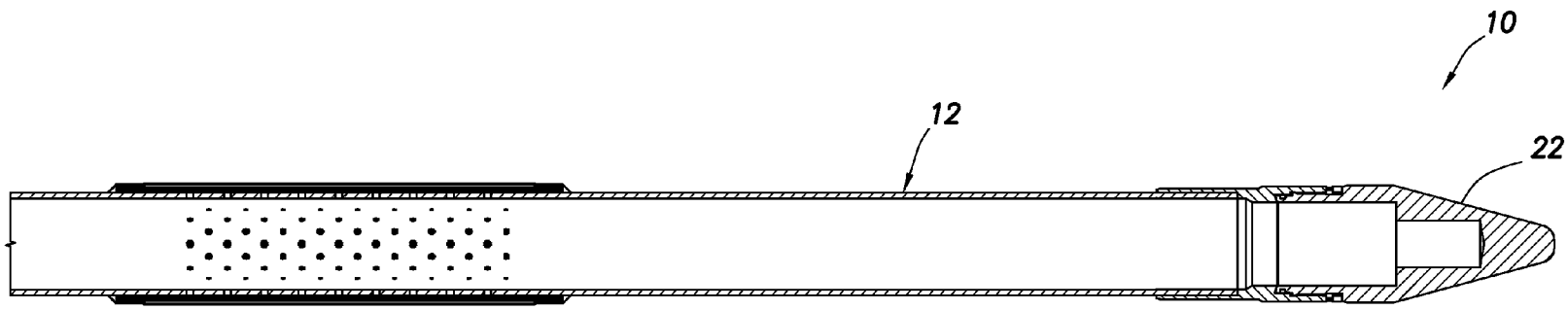
FIGS. 10A-P are schematic cross-sectional views of the gravel packing assembly and the second work string in a reverse flow configuration.
Figure 10B:
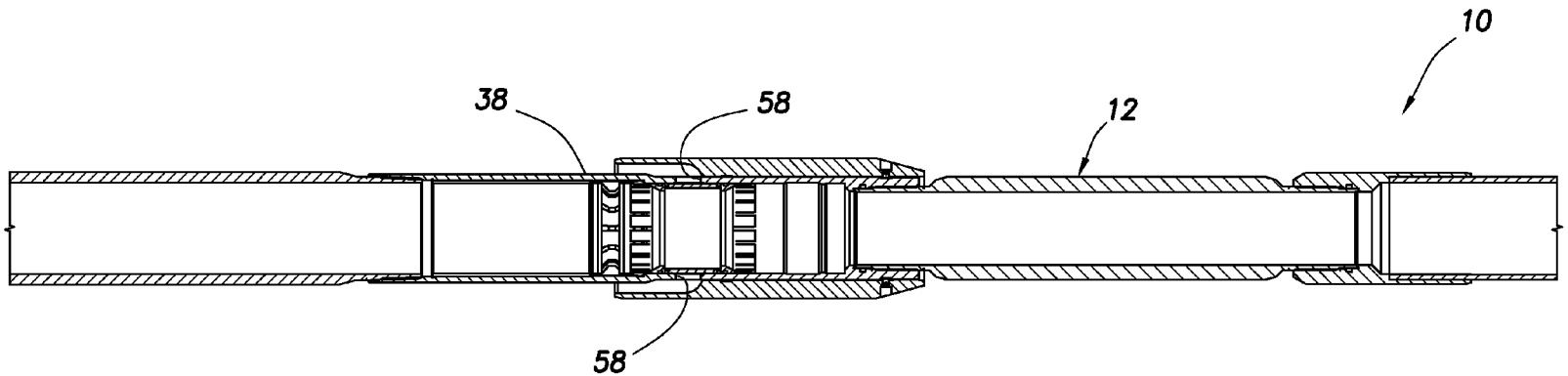
Figure 10C:
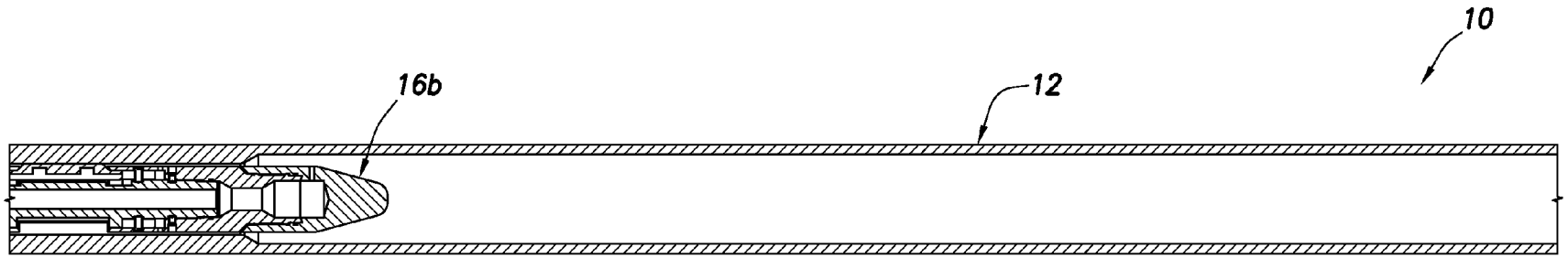
Figure 10D:
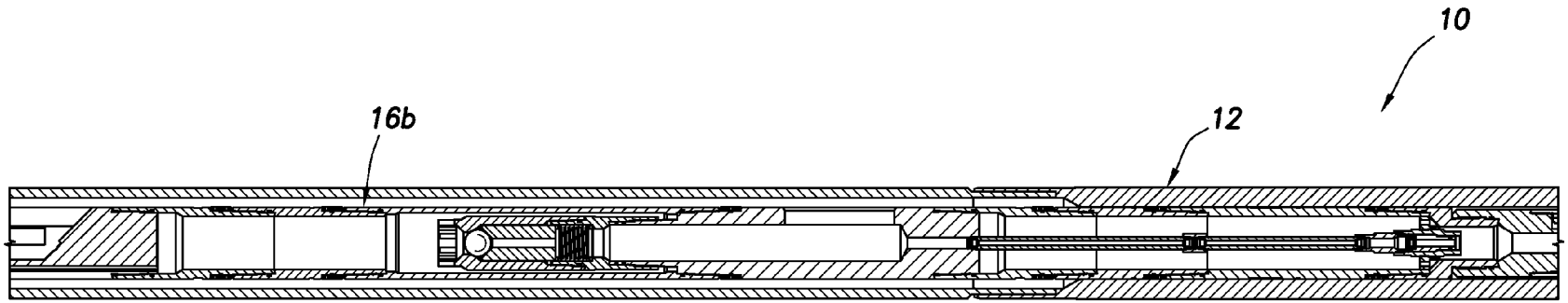
Figure 10E:
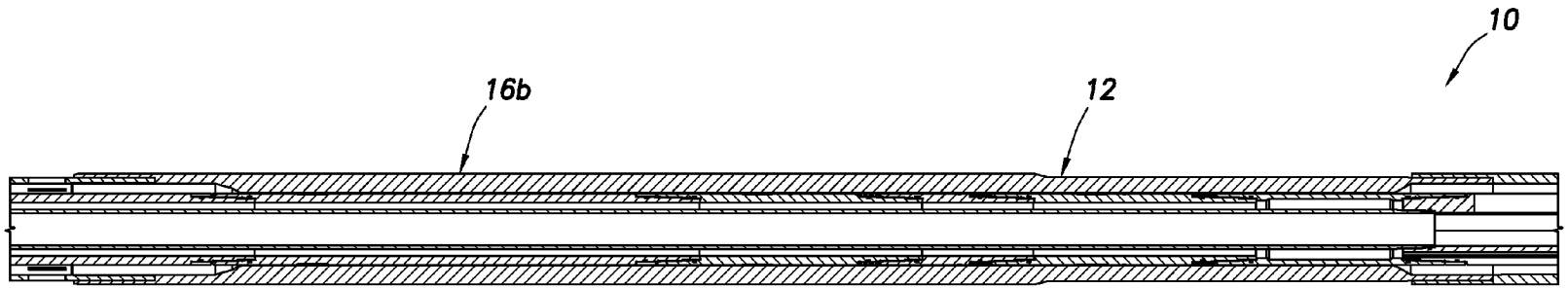
Figure 10F:
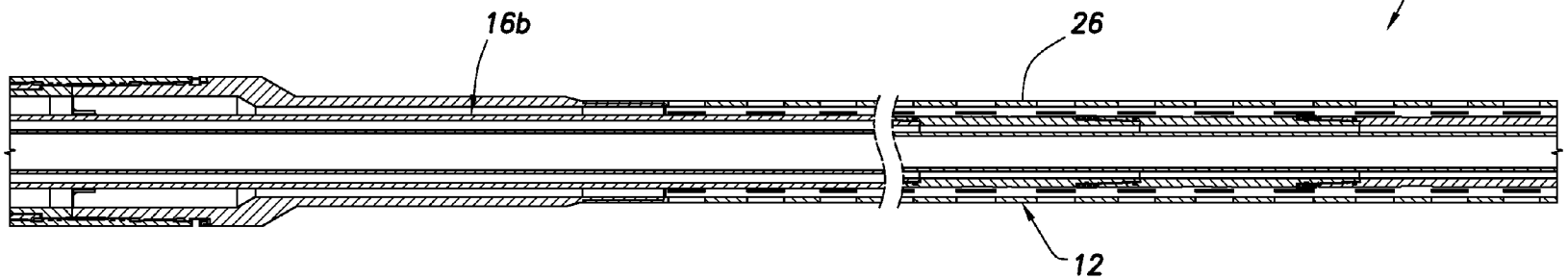
Figure 10G:
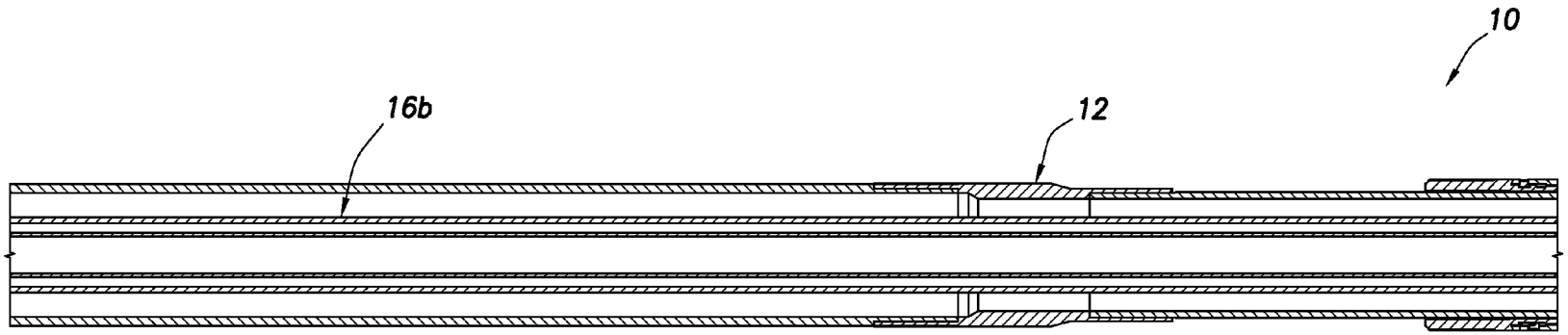
Figure 10H:
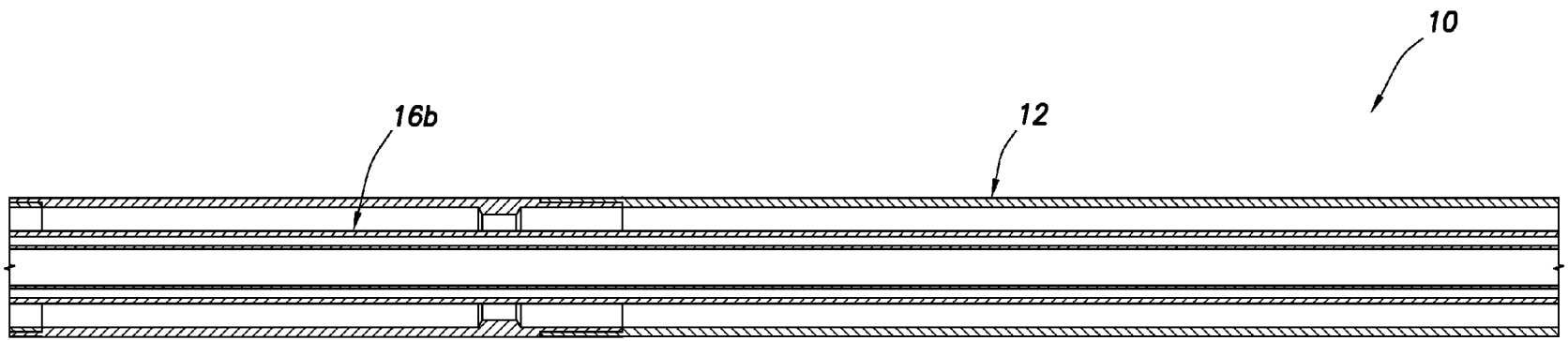
Figure 10I:
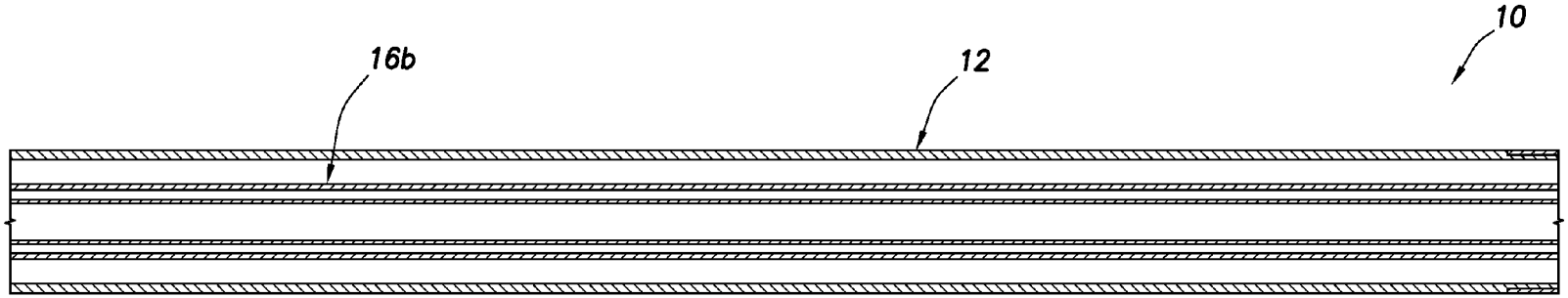
Figure 10J:
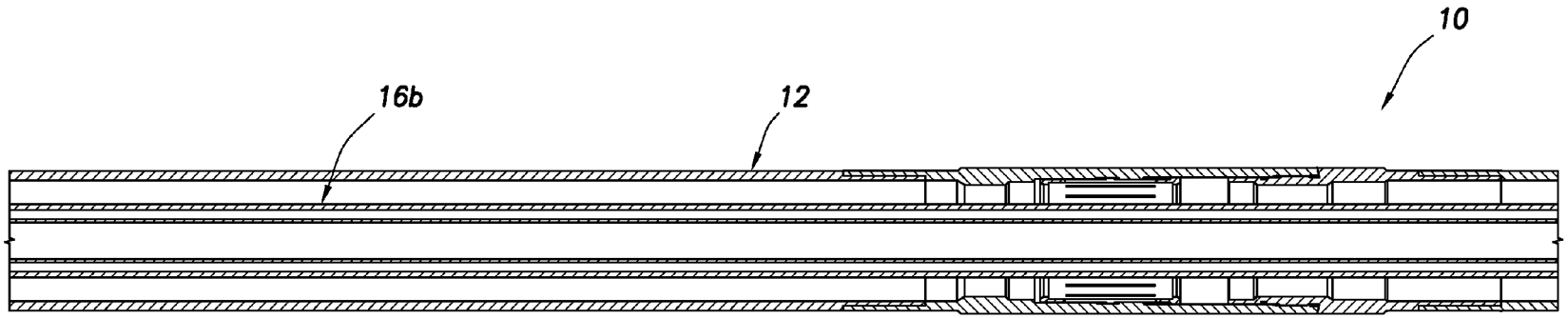
Figure 10K:
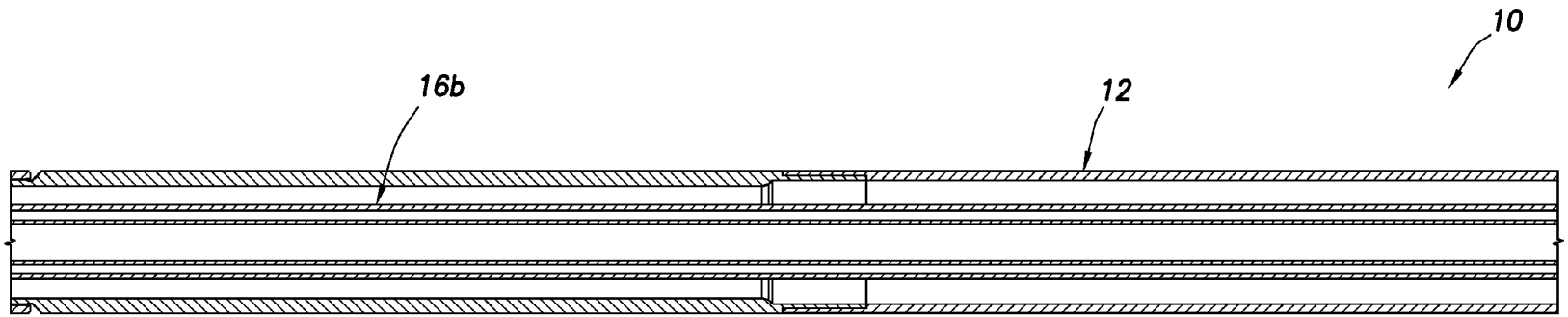
Figure 10L:
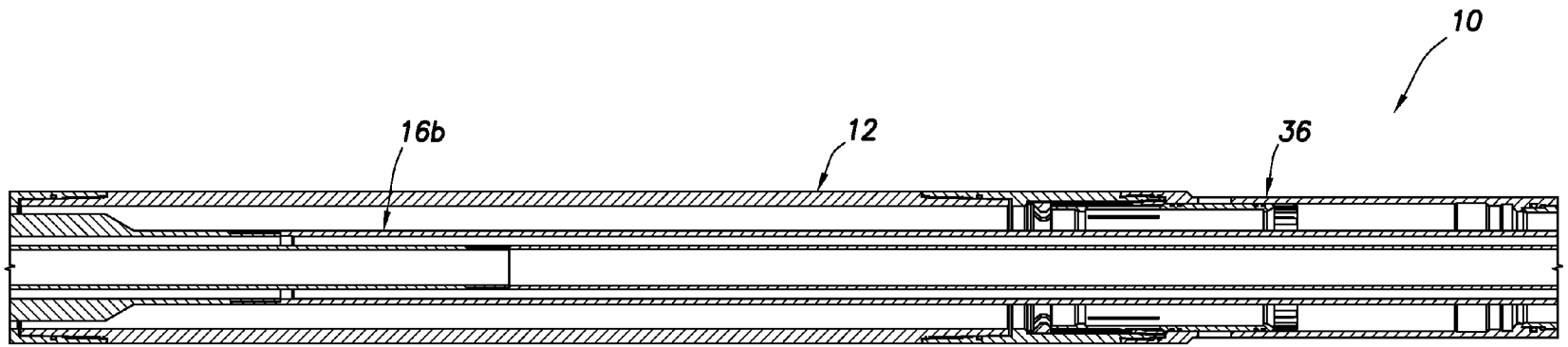
Figure 10M:
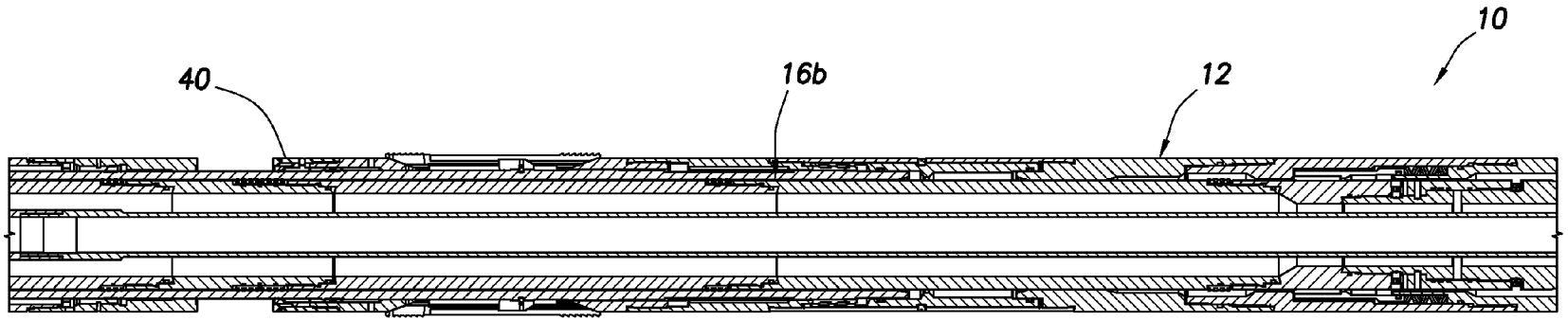
Figure 10N:
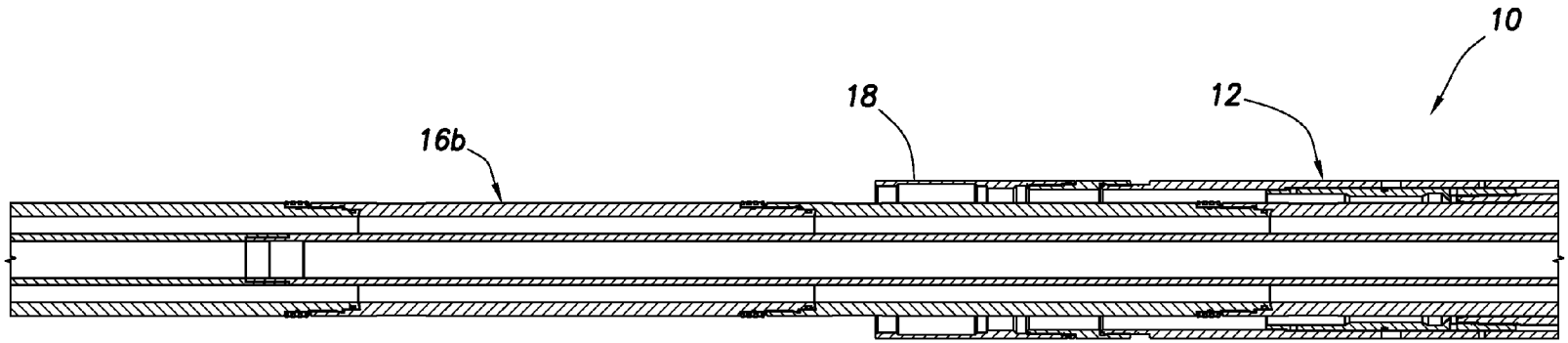
Figure 10O:
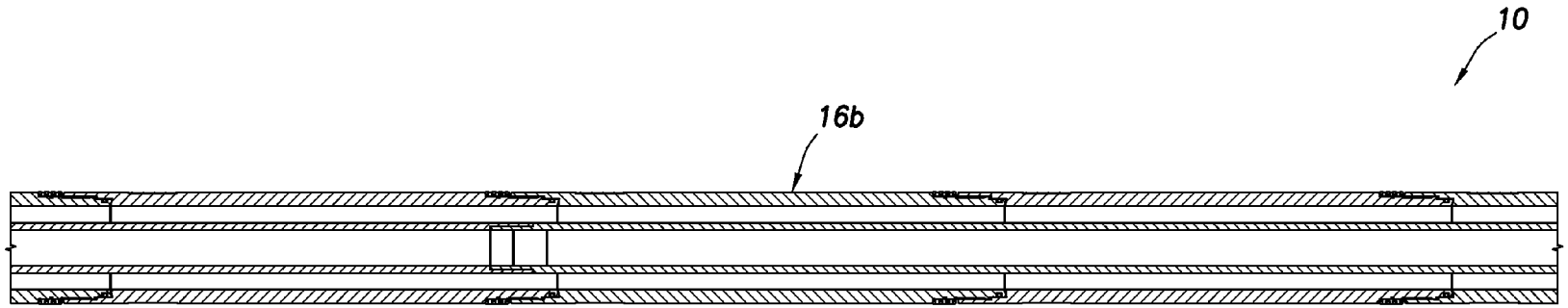
Figure 10P:
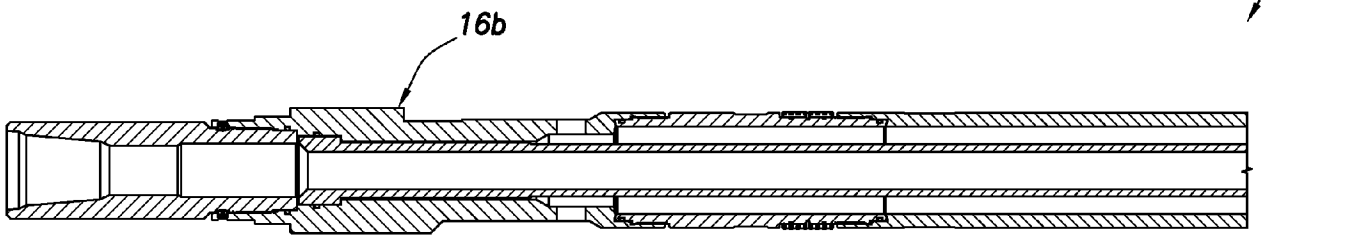

In FIGS. 10A-P, the work string 16*b* and assembly 12 are depicted in a reverse circulate configuration. The work string 16*b* has been raised to permit fluid to be circulated down the annulus 50 and up the work string 16*b* to clear the slurry 44 from the work string.

Note that, although only the gravel packing operation has been described above, other types of operations (such as perforating, stimulation, fracturing, acidizing, etc.) can also be performed in keeping with the principles of this disclosure.

It may now be fully appreciated that the above disclosure provides several advancements to the art of gravel packing systems and methods. The system 10 and associated method described above allows a continuous annulus 32 to be gravel packed, even though problems such as obstructions, premature bridging-off, etc. might otherwise prevent the entire annulus surrounding the screens 26 from being packed with gravel. The system 10 and associated method also permit gravel slurries 42, 44 to be flowed through the annulus 32 in different directions at different times.

The above disclosure describes a method of gravel packing a wellbore 14, with the method including the steps of: flowing a gravel slurry 42 in one direction in an annulus 32 formed between the wellbore 14 and a gravel packing assembly 12 positioned in the wellbore 14; and flowing another gravel slurry 44 in an opposite direction in the annulus 32.

The second gravel slurry 44 may be flowed in the annulus 32 only after the first gravel slurry 42 is flowed in the annulus 32. Alternatively, the second gravel slurry 44 may be flowed first, or the slurries 42, 44 may be flowed simultaneously.

The wellbore 14 may be deviated. The first direction may be toward a toe 28 of the deviated wellbore 14, or the first direction could be away from the toe 28.

The first gravel slurry 42 flowing step may include flowing the first gravel slurry 42 outward from a port 48 in the gravel packing assembly 12. The second gravel slurry 44 flowing step may include flowing the second gravel slurry 44 outward from another port 58 in the gravel packing assembly 12. One or more well screens 26 of the gravel packing assembly 12 may be positioned between the ports 48, 58.

The method may also include the step of, between the first and second gravel slurry flowing steps, replacing a work string 16*a* positioned in the gravel packing assembly 12.

The first gravel slurry 42 flowing step may include flowing the first gravel slurry 42 in the first direction toward a heel 30 of the wellbore 14, and the second gravel slurry 44 flowing step may include flowing the second gravel slurry 44 in the second direction toward a toe 28 of the wellbore 14. The first gravel slurry 42 flowing step may be performed prior to the second gravel slurry 44 flowing step.

The first gravel slurry 42 flowing step may include flowing the first gravel slurry 42 in the first direction toward a toe 28 of the wellbore 14. The second gravel slurry 44 flowing step may include flowing the second gravel slurry 44 in the second direction toward a heel 30 of the wellbore 14. The first gravel slurry 42 flowing step may be performed prior to the second gravel slurry 44 flowing step.

Also described by the above disclosure is a well system 10 in which a wellbore 14 is gravel packed. The well system 10 includes a gravel packing assembly 12 positioned in the wellbore 14, whereby an annulus 32 is formed between the wellbore 14 and the gravel packing assembly 12. One or more well screens 26 are interconnected in the gravel packing assembly 12. A flow control device 36, interconnected in the gravel packing assembly 12, selectively permits and prevents flow of a gravel slurry 42 outward from the gravel packing assembly 12 to an exterior of the well screens 26. Another flow control device 38, interconnected in the gravel packing assembly 12, selectively permits and prevents flow of another gravel slurry 44 outward from the gravel packing assembly 12 to the exterior of the well screens 26. The well screens 26 are positioned longitudinally between the flow control devices 36, 38.

The first gravel slurry 42 may flow in a first direction from the first flow control device 36 to the exterior of the well screens 26. The second gravel slurry 44 may flow in a second direction from the second flow control device 38 to the exterior of the well screens 26, with the second direction being opposite to the first direction.

The first direction may be toward a toe 28 of the wellbore 14, and the second direction may be away from the toe 28 of the wellbore 14. The first direction may be away from a toe 28 of the wellbore 14, and the second direction may be toward the toe 28 of the wellbore 14.

The first flow control device 36 may be operated by a work string 16*a* positioned in the gravel packing assembly 12, and the second flow control device 38 may be operated by another work string 16*b* positioned in the gravel packing assembly 12. The first and second work strings 16*a,b* may be non-coexistent in the gravel packing assembly 12.

The gravel packing assembly 12 may have a proximal end 18 and a distal end 22. The first flow control device 36 may be interconnected in the gravel packing assembly 12 proximate the proximal end 18. The second flow control device 38 may be interconnected in the gravel packing assembly 12 proximate the distal end 22.

The system 10 may include an outer shroud 60 interconnected in the gravel packing assembly 12. The outer shroud 60 may radially outwardly overlie a port 58 of the second flow control device 38, whereby the shroud 60 may deflect the second gravel slurry 44 as it flows outward through the port 58.

The above disclosure also describes a method of gravel packing a deviated wellbore 14. The method includes the steps of: flowing a gravel slurry 42 in a first direction relative to a toe 28 of the wellbore 14, the gravel slurry 42 being flowed in an annulus 32 formed between the wellbore 14 and a gravel packing assembly 12 positioned in the wellbore 14; and flowing another gravel slurry 44 in a second direction relative to the toe 28 of the wellbore 14. The second direction is opposite to the first direction, with the second gravel slurry 44 being flowed in the annulus 32.

The first gravel slurry 42 flowing step may be performed prior to the second gravel slurry 44 flowing step. Alternatively, the first gravel slurry 42 flowing step may be performed after the second gravel slurry 44 flowing step.

The first gravel slurry 42 flowing step may include flowing the first gravel slurry 42 to an exterior of one or more well screens 26 interconnected in the gravel packing assembly 12. The second gravel slurry 44 flowing step may include flowing the second gravel slurry 44 to the exterior of the well screens 26.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of gravel packing a wellbore, the method comprising the steps of:

flowing a first gravel slurry in a first direction in an annulus formed between the wellbore and a gravel packing assembly positioned in the wellbore; and concurrently flowing a second gravel slurry in a second direction in the annulus, the second direction being opposite to the first direction.

2. The method of claim 1, wherein the second gravel slurry is flowed in the annulus only after the first gravel slurry is flowed in the annulus.

3. The method of claim 1, wherein the wellbore is deviated, and wherein the first direction is toward a toe of the deviated wellbore.

4. The method of claim 1, wherein the wellbore is deviated, and wherein the first direction is away from a toe of the deviated wellbore.

5. The method of claim 1, wherein the first gravel slurry flowing step further comprises flowing the first gravel slurry outward from a first port in the gravel packing assembly, wherein the second gravel slurry flowing step further comprises flowing the second gravel slurry outward from a second port in the gravel packing assembly, and wherein one or more well screens of the gravel packing assembly are positioned between the first and second ports.

6. The method of claim 1, further comprising the step of, between the first and second gravel slurry flowing steps, replacing a first work string which is positioned in the gravel packing assembly with a second work string.

7. The method of claim 1, wherein the wellbore is deviated, wherein the first gravel slurry flowing step further comprises flowing the first gravel slurry in the first direction toward a heel of the wellbore, and wherein the second gravel slurry flowing step further comprises flowing the second gravel slurry in the second direction toward a toe of the wellbore.

8. The method of claim 1, wherein the wellbore is deviated, wherein the first gravel slurry flowing step further comprises flowing the first gravel slurry in the first direction toward a toe of the wellbore, and wherein the second gravel slurry flowing step further comprises flowing the second gravel slurry in the second direction toward a heel of the wellbore.

9. A well system in which a wellbore is gravel packed, the well system comprising:

a gravel packing assembly positioned in the wellbore, whereby an annulus is formed between the wellbore and the gravel packing assembly;

one or more well screens interconnected in the gravel packing assembly;

a first flow control device, interconnected in the gravel packing assembly, and which selectively permits and prevents flow of a first gravel slurry outward from the gravel packing assembly to an exterior of the well screens;

a second flow control device, interconnected in the gravel packing assembly, and which selectively permits and prevents flow of a second gravel slurry outward from the gravel packing assembly to the exterior of the well screens; and the well screens being positioned between the first and second flow control devices.

10. The system of claim 9, wherein the first gravel slurry flows in a first direction from the first flow control device to the exterior of the well screens, and wherein the second gravel slurry flows in a second direction from the second flow control device to the exterior of the well screens, the second direction being opposite to the first direction.

11. The system of claim 10, wherein the first direction is toward a toe of the wellbore, and wherein the second direction is away from the toe of the wellbore.

12. The system of claim 10, wherein the first direction is away from a toe of the wellbore, and wherein the second direction is toward the toe of the wellbore.

13. The system of claim 9, wherein the first flow control device is operated by a first work string positioned in the gravel packing assembly, and wherein the second flow control device is operated by a second work string positioned in the gravel packing assembly.

14. The system of claim 13, wherein the first and second work strings are not concurrently positioned in the gravel packing assembly.

15. The system of claim 9, wherein the gravel packing assembly has a proximal end and a distal end, wherein the first flow control device is interconnected in the gravel packing assembly proximate the proximal end, and wherein the second flow control device is interconnected in the gravel packing assembly proximate the distal end.

16. The system of claim 15, further comprising an outer shroud interconnected in the gravel packing assembly, the outer shroud radially outwardly overlying a port of the second flow control device, whereby the shroud deflects the second gravel slurry as the second gravel slurry flows outward through the port.

17. A method of gravel packing a deviated wellbore, the method comprising the steps of:

flowing a first gravel slurry outward from a gravel packing assembly and in a first direction relative to a toe of the wellbore, the first gravel slurry being flowed in an annulus formed between the wellbore and the gravel packing assembly positioned in the wellbore; and flowing a second gravel slurry outward from the gravel packing assembly and in a second direction relative to the toe of the wellbore, the second direction being opposite to the first direction, and the second gravel slurry being flowed in the annulus.

18. The method of claim 17, wherein the first gravel slurry flowing step is performed prior to the second gravel slurry flowing step.

19. The method of claim 17, wherein the first gravel slurry flowing step is performed after the second gravel slurry flowing step.

20. The method of claim 17, wherein the first gravel slurry flowing step further comprises flowing the first gravel slurry to an exterior of one or more well screens interconnected in the gravel packing assembly, and wherein the second gravel slurry flowing step further comprises flowing the second gravel slurry to the exterior of the well screens.

* * * * *